US006411785B1

(12) United States Patent
Ogawahara et al.

(10) Patent No.: US 6,411,785 B1
(45) Date of Patent: Jun. 25, 2002

(54) FIXING UNIT, FIXING METHOD AND IMAGE FORMING APPARATUS USING THE SAME

(75) Inventors: Norio Ogawahara; Hiroyuki Ohtsuka; Yasuto Okabayashi, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/716,270

(22) Filed: Nov. 21, 2000

(30) Foreign Application Priority Data

Nov. 29, 1999 (JP) ..... 11-338432

(51) Int. Cl.[7] ..... G03G 15/20
(52) U.S. Cl. ..... 399/69; 399/45; 399/331
(58) Field of Search ..... 399/45, 330, 331, 399/335, 336, 337, 67, 69

(56) References Cited

U.S. PATENT DOCUMENTS 4,977,431 A * 12/1990 Fuji ..... 399/69
5,289,247 A * 2/1994 Takano et al. ..... 399/45 X
5,512,992 A * 4/1996 Kim et al. ..... 399/69
5,708,920 A * 1/1998 Ohnishi et al. ..... 399/69
5,809,368 A * 9/1998 Menjo et al. ..... 399/45 X
6,173,136 B1 * 1/2001 Fuchiwaki et al. ..... 399/67

FOREIGN PATENT DOCUMENTS

| | | |
|---|---|---|
| JP | 6-11997 | 1/1994 |
| JP | 10-149044 | 6/1998 |
| JP | 11-24489 | 1/1999 |

* cited by examiner

*Primary Examiner*—Fred L. Braun
(74) *Attorney, Agent, or Firm*—Morgan, Lewis & Bockius LLP

(57) ABSTRACT

A fixing unit prevents surface temperature of a fixing roller from becoming too high or too low and of always attains good fixing performance by employing an external heating method that makes an external heating member abut the surface of the fixing roller to heat the surface of the fixing roller. The fixing unit has the fixing roller having a heating source therein, a pressurizing member which press-contacts the fixing roller, the external heating member which heats the surface of the fixing roller from the outside, an abutting-separating device that makes the external heating member abut or separate from the surface of the fixing roller; and a control unit which controls timing for making the external heating member abut the surface of the fixing roller according to at least one of the surface temperature of the external heating member and/or fixing roller, the type of the transfer medium which undergoes the fixing process and an image forming mode for the transfer medium.

16 Claims, 17 Drawing Sheets

FIG.1A

| | TEMPERATURE OF EXTERNAL HEATING ROLLER | HIGHER THAN PREDETERMINED VALUE | | LOWER THAN PREDETERMINED VALUE | |
|---|---|---|---|---|---|
| | DIFFERENCE OF TEMPERATURE OF EXTERNAL HEATING ROLLER AND FIXING ROLLER | LARGE | SMALL | LARGE | SMALL |
| FULL-COLOR | PLAIN PAPER | C | D | A | B |
| | THICK PAPER 1 | C | D | B | C |
| | THICK PAPER 2 | C | D | B | C |
| | OHP | C | E | B | E |
| BLACK-AND-WHITE | PLAIN PAPER | C | C | A | A |
| | THICK PAPER 1 | C | D | B | C |
| | THICK PAPER 2 | C | D | B | C |
| | OHP | C | C | A | A |

FIG.1B

| STATE OF ROLL TEMPERATURE IN ENDING PREVIOUS JOB | ABUTMENT/SEPARATION OF FIXING ROLLER AND EXTERNAL HEATING ROLLER | ABUTMENT/SEPARATION OF FIXING ROLLER AND PRESSURE ROLLER |
|---|---|---|
| FIXING ROLLER IS LOWER THAN PRESET TEMPERATURE | ABUT | SEPARATE |
| PRESSURE ROLLER IS LOWER THAN PRESET TEMPERATURE | ABUT | ABUT |
| FIXING ROLLER AND PRESSURE ROLLER ARE BOTH LOWER THAN PRESET TEMPERATURE | ABUT | ABUT |

FIG.8

START PRINTING OPERATION

ST101

TAKE IN ROLL TEMPERATURE
TEMPERATURE OF EXTERNAL HEATING ROLLER : $T_{EXT}$
TEMPERATURE OF FIXING ROLLER : $T_H$

ST102

CALCULATE DIFFERENCE OF TEMPERATURE OF EXTERNAL HEATING ROLLER AND FIXING ROLLER $\Delta T_{EXT-H}$
$T_{EXT} - T_H = \Delta T_{EXT-H}$

ST103

TAKE IN COLOR MODE AND QUALITY OF PAPER
COLOR MODE = COLOR OR BLACK-AND-WHITE
TYPE OF PAPER = PLAIN PAPER, THICK PAPER 1, THICK PAPER 2 OR OHP

ST104

DECIDE ABUTMENT PATTERNS A THROUGH E OF EXTERNAL HEATING ROLLER BY TYPE OF PAPER

| | $T_{EXT}$ | ≧T1 | | <T1 | |
|---|---|---|---|---|---|
| | $\Delta T_{EXT-H}$ | ≧T2 | <T2 | ≧T2 | <T2 |
| COLOR | PLAIN PAPER | C | D | A | B |
| | THICK PAPER 1 | C | D | B | C |
| | THICK PAPER 2 | C | D | B | C |
| | OHP | C | E | B | E |
| BLACK-AND-WHITE | PLAIN PAPER | C | C | A | A |
| | THICK PAPER 1 | C | D | B | C |
| | THICK PAPER 2 | C | D | B | C |
| | OHP | C | C | A | A |

A

FIG.15

| PATTERN | ROLL TEMPERATURE | | ABUT/SEPARATE FIXING ROLLER AND EXTERNAL HEATING ROLLER | ABUT/SEPARATE FIXING ROLLER AND PRESSURE ROLLER |
|---|---|---|---|---|
| | $T_H$ | $T_P$ | | |
| ① | $T_H \geqq T_{H\,CONT}$ | $T_P \geqq T_{P\,CONT}$ | SEPARATE | SEPARATE |
| ② | $T_H < T_{H\,CONT}$ | $T_P \geqq T_{P\,CONT}$ | ABUT | SEPARATE |
| ③ | $T_H \geqq T_{H\,CONT}$ | $T_P < T_{P\,CONT}$ | ABUT | ABUT |
| ④ | $T_H < T_{H\,CONT}$ | $T_P < T_{P\,CONT}$ | ABUT | ABUT |

FIXING UNIT, FIXING METHOD AND IMAGE FORMING APPARATUS USING THE SAME

BACKGROUND OF THE INVENTION

1. Field of the Invention

The present invention relates to a fixing unit for use in an image forming apparatus such as a copying machine, a printer and a facsimile applying an electrophotographic or electrostatic recording scheme and to an image forming apparatus using the same. More specifically, present invention relates to a fixing unit capable of always performing a good fixing process regardless of the type of a transfer medium and an image forming mode and to an image forming apparatus using the same.

2. Related Art Statement

Hitherto, there has been a unit as shown in FIG. 17 for example as a fixing unit for heating and fixing a non-fixed toner image which has been transferred to a copy sheet in an image forming apparatus such as a copying machine, a printer and a facsimile applying electrophotographic or electrostatic recording scheme. As shown in FIG. 17, the fixing unit is constructed so as to melt and fix a toner image 103 on a copy sheet 104 by heating and pressing it by passing the copy sheet 104 carrying the non-fixed toner image 103 through a pressure-contact area between a pair of rollers 101 and 102 wherein at least one roller has a heating source.

In FIG. 17, the reference numeral (101) denotes a fixing roller and (102) a pressure roller. The fixing roller 101 is structured by coating a relatively thick heat-resistant elastic layer 112 made of silicon rubber or the like and a top coat layer 113 made of fluorine rubber or the like on the surface of a metal hollow core 111 made of aluminum or the like whose thermal conductivity is high. A halogen lamp 114 is disposed as a heating source within the metal hollow core 111 and is turned on/off by a temperature control circuit not shown based on a signal from a temperature sensor 115 provided on the surface of the fixing roller 101 to control the surface at predetermined temperature. Further, an oil supply unit 105 for supplying a certain amount of silicon oil is provided on the surface of the fixing roller 101 to prevent a part of the non-fixed toner image 103 on the copy sheet 104 from being transferred to the fixing roller 101 (hereinafter referred to as "offset") during fixing. A cleaning unit 106 for removing offset toner and the like is also provided on the surface of the fixing roller 101.

Meanwhile, the pressure roller 102 is structured by coating a heat-resistant elastic layer 122 which is made of silicon rubber or the like and which is relatively thinner than the elastic layer 112 of the fixing roller 101 and a top coat layer 123 made of fluorine rubber or the like on the surface of a metal hollow core 121 made of aluminum or the like whose thermal conductivity is high. A halogen lamp 124 is disposed as a heating source within the metal hollow core 121 and is turned on/off by the temperature control circuit not shown based on a signal from a temperature sensor 125 provided on the surface of the pressure roller 102 to control the surface at predetermined temperature.

In the heating roller type fixing unit constructed as described above, a pressure-contact part (hereinafter referred to as a "nip") 107 is created by elastic deformation of the elastic layer 112 of the fixing roller 101. The non-fixed toner image 103 is melted and is fixed on the copy sheet 104 by thermal energy and pressure as the copy sheet 104 carrying the non-fixed toner image 103 passes through the nip 107 in such fixing unit.

However, the prior art technology described above has had the following problems. While the fixing roller 101 and the pressure roller 102 have the elastic layers 112 and 122 in the fixing unit constructed as described above, these elastic layers 112 and 122 are made of elastic member such as silicon rubber which has a certain thickness and whose thermal conductivity is relatively low. Therefore, when the surface temperature of the fixing roller 101 or of the pressure roller 102 drops below the predetermined temperature while feeding papers, there has been a possibility in the fixing unit described above that it takes time to transmit heat of the halogen lamps 114 and 124 to the surface via the elastic layers 112 and 122, thus causing fixing failure, even if the temperature sensors 115 and 125 detect the drop of the temperature and power is fed to the halogen lamps 114 and 124. The fixing failure is liable to occur when processing speed increases in particular and there has been a problem that continuous printing is limited in order to prevent the fixing failure from occurring.

Then, in order to solve such problems, there has been already proposed a technology for slowing down the drop of the temperature of the surface of the fixing roller by abutting an external heating roller whose temperature is kept high to the surface of the fixing roller as disclosed in Japanese Patent Laid-Open Nos. Hei. 10-149044 and Hei. 11-24489.

However, in case of the technology disclosed in Japanese Patent Laid-Open Nos. Hei. 10-149044 and Hei. 11-24489 described above, the external heating roller whose temperature is kept high is abutted to the surface of the fixing roller immediately when the sensor detects that the surface temperature of the fixing roller has dropped even though the optimum surface temperature of the fixing roller is different depending on the type of the copy sheet 104 and on image forming modes such as black-and-white mode and color mode. Therefore, there has been a case when the temperature of the fixing roller in fixing papers differs considerably from temperature suitable as conditions for fixing papers such as the copy sheet depending on the temperature of the external heating roller and the fixing roller. Accordingly, the technology disclosed in Japanese Patent Laid-Open Nos. Hei. 10-149044 and Hei. 11-24489 has had a possibility that it may cause new problems such as an increase of offset toner, a failure in peeling OHP sheets and insufficient fixing.

More specifically, in case of the technology disclosed in Japanese Patent Laid-Open Nos. Hei. 10-149044 and Hei. 11-24489, the surface temperature of the fixing roller 101 rises considerably above the predetermined temperature when the external heating roller not shown whose surface temperature is high abuts to the surface of the fixing roller 101 in the process when the surface temperature of the fixing roller 101 rises due to temporal delay of the increase of the surface temperature of the fixing roller 101 as shown in FIG. 18. Then, because the surface temperature of the fixing roller 101 is considerably higher than the predetermined temperature, it has caused problems that the non-fixed toner image 103 to be fixed on the copy sheet 104 melts excessively, thus dropping the gross, an amount of toner transferred to the surface of the fixing roller 101 increases (called as hot offset), and the deterioration of the elastic layer 112 and the top coat layer 113 of the fixing roller 101 is accelerated. Still more, when the surface temperature of the fixing roller 101 is considerably higher than the predetermined temperature and when a transfer medium 104 made of a synthetic resin film called as an OHP sheet and a tack film is used, there has been a problem that those synthetic resin films such as the OHP sheet and the tack film are softened and are wrapped around the surface of the fixing roller 101, thus making it impossible to perform the fixing process. Meanwhile, there has been a case when the surface temperature of the fixing roller 101 is lower than the predetermined temperature, thus causing insufficient fixing, depending on the surface temperature of the fixing roller 101 and the surface temperature of the external heating roller.

As a second problem, there has been a case when the surface temperature of the fixing roller 101 and the pressure roller 102 drops gradually as the heat of the fixing roller 101 and the pressure roller 102 is taken away gradually by the copy sheets 104 when a continuous run job of a large number of sheets is executed by performing the fixing process of the large number of copy sheets continuously by the fixing unit as shown in FIG. 17. A type of machine in which power consumption of the fixing unit is required to be low shows this tendency remarkably because the halogen lamps whose power consumption is large cannot be used as the heating sources 114 and 124. Accordingly, when the next continuous run job of a large number of sheets is carried out under the condition in which the temperature of the fixing roller 101 and the pressure roller 102 has dropped due to the previous continuous run job, the temperature of the rollers drops below the lowest fixing temperature during the job and the temperature must be recovered by stopping the run.

However, the elastic layers 112 and 122 of the fixing roller 101 and the pressure roller 102 for color fixing have had the problems as described before that because the thermal conductivity is relatively low, the recovery of temperature of the surface of the roller after feeding the sheets is slow and the continuous job cannot be executed. Still more, it has had a problems that the surface temperature of the fixing roller 101 and the pressure roller 102 rises considerably above the set temperature this time after recovering the surface temperature of the fixing roller 101 and the pressure roller 102 to the set temperature and an overshoot is large, thus causing the increase of toner offset and the peeling defective jam of OHP sheets or the like as described before when the copy sheets 104 are fed in the state when the temperature has risen excessively.

Then, in order to solve the above-mentioned problems, the applicant of the present invention has already proposed a technology for recovering the temperature of the fixing roller and others by utilizing the phenomenon of overshoot while preventing defective image which is otherwise caused by the overshoot as disclosed in Japanese Patent Laid-Open No. Hei. 6-11997.

However, the technology disclosed in Japanese Patent Laid-Open No. Hei. 6-11997 has had a problem that it takes a certain time for the surface temperature of the fixing roller to recover to the predetermined temperature, thus delaying the next fixing process, because it recovers the temperature of the fixing roller while utilizing the overshoot phenomenon by setting two control temperatures of first and second control temperatures as the surface temperature of the fixing roller and by switching the first and second control temperatures at predetermined timing.

SUMMARY OF THE INVENTION

The present invention has been made in order to solve the problems of the above-mentioned prior art and provides a fixing unit, and an image forming apparatus using the same, which is capable of attaining always good fixing performance by preventing the surface temperature of the fixing roller from becoming too high or too low even when it is constructed so as to heat the surface of the fixing roller by an external heating member by abutting it to the surface of the fixing roller.

The invention also provides a fixing unit, and an image forming apparatus using the same, which is capable of returning the surface temperature of the fixing roller to set temperature in a short time and of preventing an overshoot or the like from occurring even when the fixing process is continuously run.

According to a first aspect of the invention, an image forming apparatus has a fixing unit that fixes a black-and-white or color toner image which has been formed on a transfer medium by an image forming unit on the transfer medium and a control unit. The fixing unit includes a fixing roller having a heating source therein; a pressurizing member which press-contacts the fixing roller; an external heating member which heats the surface of the fixing roller from the outside; and an abutting-separating device that makes the external heating member abut or separate from the surface of the fixing roller. The control unit controls timing for making the external heating member abut the surface of the fixing roller according to at least one of the surface temperature of the external heating member and/or fixing roller, the type of the transfer medium which undergoes the fixing process by the fixing unit and an image forming mode for the transfer medium.

According to a second aspect of the invention, an image forming apparatus has a fixing unit that fixes a black-and-white or color toner image which has been formed on a transfer medium by an image forming unit on the transfer medium and a control unit. The fixing unit includes a fixing roller having a heating source therein; a pressurizing member which has a heating source therein and press-contacts the fixing roller; an external heating member which heats the surface of the fixing roller from the outside; a first abutting-separating device which makes the pressurizing member press-contact or separate from the surface of the fixing roller; and a second abutting-separating device which makes the external heating member abut or separate from the surface of the fixing roller. The control unit carries out at least one of a control of continuous abutting of the external heating member to the fixing roller when at least one of surface temperatures of the fixing roller and the pressurizing member is lower than a preset temperature and a control of continuous abutting of the pressurizing member to the fixing roller at the point of time when the fixing process by the fixing unit ends.

According to a third aspect of the invention, an external heating method is provided for heating the surface of a fixing roller having a heating source therein by making an external heating member abut the surface of the fixing roller by an abutting-separating device for making the external heating member abut or separate from the surface of the fixing roller. The method includes a temperature measuring step for measuring the surface temperature of the fixing roller; and a timing deciding step of finding the difference between the surface temperature of the fixing roller measured in the previous step and predetermined temperature and of deciding timing for making the external heating member abut the fixing roller by the abutting-separating device according to an image forming mode to make the external heating member abut the fixing roller by the abutting-separating device.

According to a fourth aspect of the invention, an external heating method using the image forming apparatus of the second aspect, the method includes the steps of measuring and inputting the surface temperatures of the fixing roller and the pressurizing member at the point of time when the fixing process by the fixing unit ends, and providing a control for making at least one of the external heating member and the pressurizing member abut or press-contact the fixing roller if at least one of surface temperatures of the fixing roller and the pressurizing member is lower than a preset temperature.

BRIEF DESCRIPTION OF THE DRAWINGS

Preferred embodiments of the present invention will be described in detail based on the following figures, wherein:

FIGS. 1A and 1B are tables showing control operations of a fixing unit of a first embodiment of the invention;

FIG. 8 is a flowchart showing a fixing operation of the fixing unit of the first embodiment of the invention;

FIG. 15 is a table showing control operations of the fixing unit of the second embodiment of the invention;

DESCRIPTION OF THE PREFERRED EMBODIMENTS

Preferred embodiments of the present invention will be explained with reference to the drawings.

First Embodiment

Figure 2:
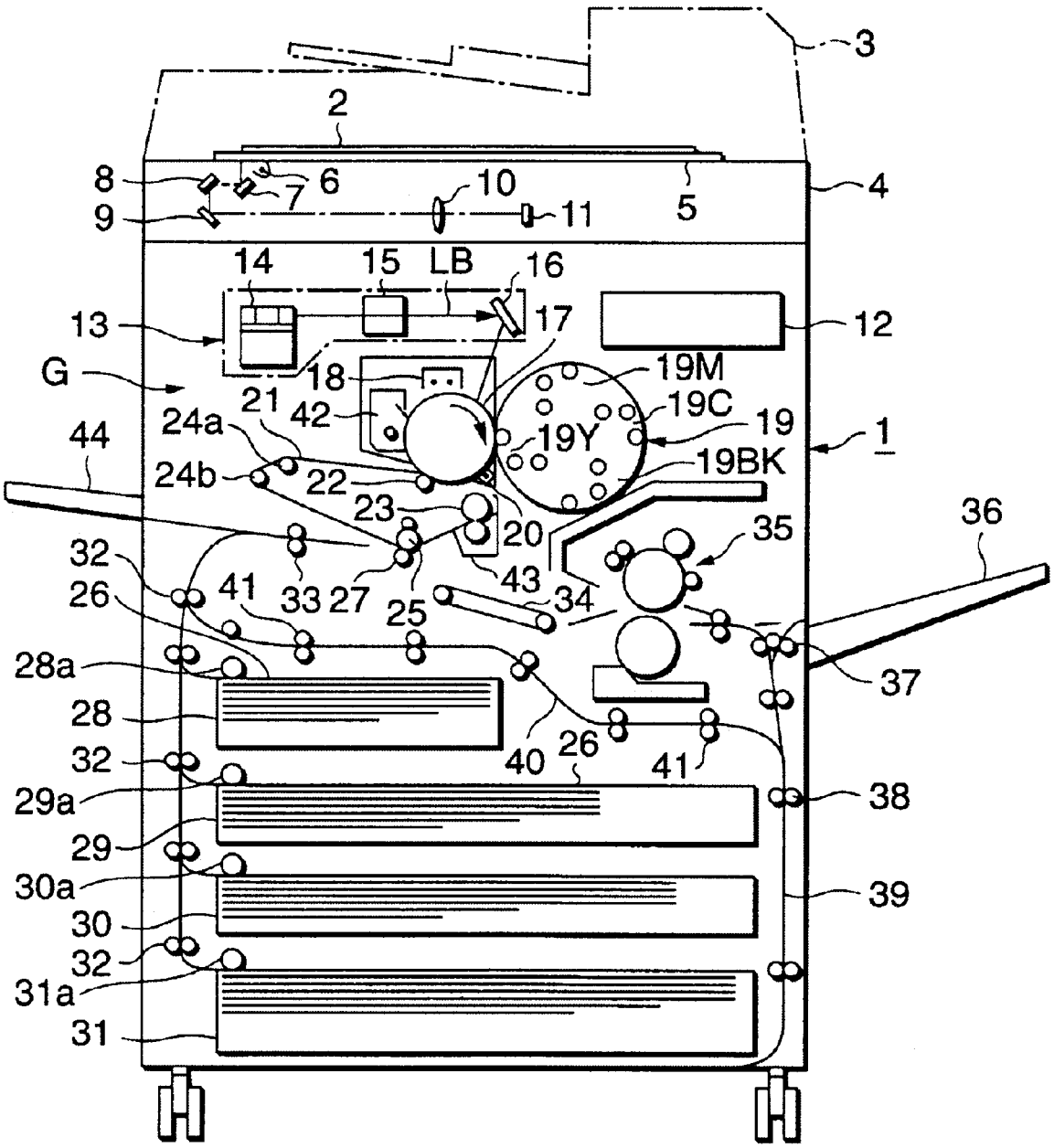
FIG. 2 is a diagram showing the structure of a color electrophotographic copying machine as an image forming apparatus to which the fixing unit of the first embodiment of the invention is applied.

FIG. 2 is a diagram showing the structure of a color electrophotographic copying machine as an image forming apparatus to which the fixing unit of the first embodiment of the invention is applied. It is noted that the invention may be applied to image forming apparatus such as a printer and a facsimile in the same manner as a matter of course.

In FIG. 2, the reference numeral (1) denotes the main body of the color electrophotographic copying machine. Disposed at the upper part of the main body 1 of the color electrophotographic copying machine are an automatic document feeder 3 for automatically feeding a document 2 while separating one by one and a document reading unit 4 for reading an image of the document 2 fed by the automatic document feeder 3. The document reading unit 4 is constructed so as to illuminate the document 2 placed on a platen glass 5 by a light source 6, to scan and expose a reflected light image from the document 2 on an image reading device 11 composed of CCD or the like via a reduced optical system having a full-rate mirror 7, half-rate mirrors 8 and 9 and an imaging lens 10 and to read the color reflected image of the document 2 by the image reading device 11 at predetermined dot density, e.g., 16 dots/mm.

The color reflected light image of the document 2 read by the document reading unit 4 is sent to an image processing unit 12 as document reflectivity data of three colors of red (R), green (G) and blue (B) (each 8 bits). The image processing unit 12 implements predetermined image processing such as correction of shading, correction of dislocation, conversion of lightness/color space, gamma correction, deletion of frame, edition of color/move and others to the reflectivity data of the document 2.

Then, the image data to which the predetermined image processing has been implemented by the image processing unit 12 as described above is sent to an ROS (Raster Output Scanner) 13 as four color document color gradation data of yellow (Y), magenta (M), cyan (C) and black (BK) (each 8 bits) and the ROS 13 exposes the image by laser beam corresponding to the document color gradation data.

An image forming unit G capable of forming plural different color toner images is disposed within the main body 1 of the color electrophotographic copying machine. The image forming unit G includes mainly a photographic drum 17 as an image carrier on which an electrostatic latent image is formed and a rotary type developing unit 19 as a developing section capable of forming plural different color toner images by developing the electrostatic latent images formed on the photographic drum 17.

The ROS 13 modulates a semiconductor laser not shown in correspondence to the document reproducing color material gradation data and outputs a laser beam LB from the semiconductor laser corresponding to the gradation data as shown in FIG. 2. The laser beam LB outputted from the semiconductor laser is deflected and scanned by a rotary polygon mirror 14 and is scanned and exposed on the photographic drum 17 as the image carrier via a f·θ lens 15 and a reflection mirror 16.

The photographic drum 17 on which the laser beam LB is scanned and exposed by the ROS 13 is driven and turned at predetermined speed along the direction of an arrow by a driving unit not shown. The surface of the photographic drum 17 is charged to predetermined polarity, e.g., minus polarity, and potential by a primary charging screen corotron 18 in advance. Then, the electrostatic latent image is formed thereon as the laser beam LB is scanned and exposed corresponding to the document reproducing coloring material gradation data. The electrostatic latent image formed on the photographic drum 17 is inversely developed by toner (charging coloring material) which is charged to minus polarity similarly to the charging polarity of the photographic drum 17 for example to put into a toner image of predetermined color by the rotary type developing unit 19 having developers 19Y, 19M, 19C and 19BK of the four colors of yellow (Y), magenta (M), cyan (C) and black (BK). It is noted that the quantity of charge of the toner image formed on the photographic drum 17 is controlled by charging the minus polarity by a pre-transfer charger 20 as necessary.

The toner images of the respective colors formed on the photographic drum 17 are transferred in multiplex onto an intermediate transfer belt 21 as an intermediate transfer member disposed under the photographic drum 17 by a primary transfer roller 22 as a first transfer section. The intermediate transfer belt 21 is supported by a driving roller 23, a follower roller 24*a*, a tension roller 24*b* and a backup roller 25 as an opposed roller which forms a part of a secondary transfer section turnably along the direction of the arrow at the same moving speed with the peripheral speed of the photographic drum 17.

The toner images of all or part of the four colors of yellow (Y), magenta (M), cyan (C) and black (BK) formed on the photographic drum 17 are transferred and superimposed one after another onto the intermediate transfer belt 21 by the primary transfer roller 22 corresponding to the colors of the image to be formed. The toner image T transferred onto the intermediate transfer belt 21 is transferred onto a copy sheet 26, which is conveyed to the secondary transfer position as a recording medium at predetermined timing, by pressurizing force and electrostatic force of the backup roller 25 for supporting the intermediate transfer belt 21 and a secondary transfer roller 27 composing a part of the second transfer section which press-contacts with the backup roller 25. The copy sheet 26 of predetermined size is fed from any one of plural feed cassettes 28, 29, 30 and 31 disposed at the under part of the main body 1 of the color electrophotographic copying machine by feed rollers 28*a*, 29*a*, 30*a* and 31*a* as shown in FIG. 2. The fed copy sheet 26 is conveyed to secondary transfer position of the intermediate transfer belt 21 at predetermined timing by plural conveyor rollers 32 and resist rollers 33. Then, the toner image T of the predetermined color is transferred in batch to the copy sheet 26 from the intermediate transfer belt 21 by the backup roller 25 and the secondary transfer roller 27 as the secondary transfer section as described above.

The copy sheet 26 on which the toner image T of the predetermined color has been transferred from the intermediate transfer belt 21 is separated from the intermediate transfer belt 21 and is then conveyed to a fixing unit 35 of the first embodiment of the invention by a conveyor belt 34. The fixing unit 35 fixes the toner image T on the copy sheet 26 by heat and pressure. The copy sheet 26 is discharged to a feeder output tray 36 as it is and the color image copying process ends in case of copying one side.

In case of double-side copy, the conveyor direction of the copy sheet 26 wherein the color image has been formed on a first face (surface) is changed downward by a reversing gate not shown without discharging to the feeder output tray 36. It is fed once to a reversing path 39 by a tri-roller 37 in which three rollers are pressed in contact and a reversing roller 38. Then, the copy sheet 26 is conveyed to a double-side path 40 by the reversing roller 38 which rotates reversely this time and is conveyed once to the resist roller 33 by a conveyor roller 41 provided along the double-side path 40 to stop there. The copy sheet 26 is started to be conveyed again by the resist roller 33 in synchronism with the toner image T on the intermediate transfer belt 21 and is discharged to the feeder output tray 36 after implementing the transfer and fixing processes of the toner image T on the second face (back) of the copy sheet 26.

It is noted that, in FIG. 2, the reference numeral (42) denotes a cleaning unit for removing residual toner, paper dust and the like from the surface of the photographic drum 17 after finishing the transferring process, (43) an intermediate transfer belt cleaner for cleaning the intermediate transfer belt 21, and (44) a manual feed tray, respectively.

Figure 3:
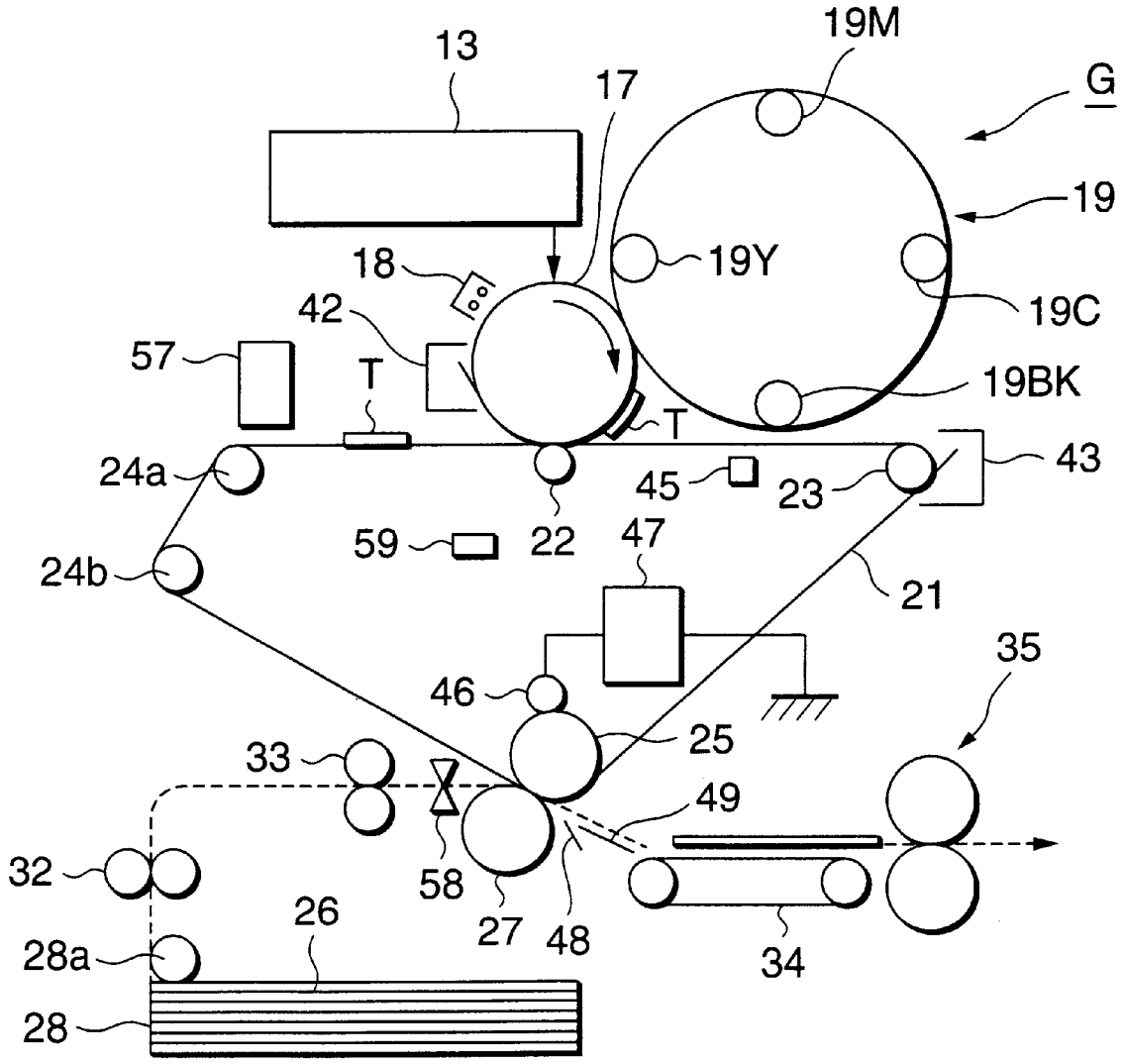
FIG. 3 is a diagram showing the structure of an image forming apparatus of the color electrophotographic copying machine.

FIG. 3 is a diagram showing the structure of the image forming unit G of the color electrophotographic copying machine.

As described above, in the color electrophotographic copying machine, the surface of the photographic drum 17 is charged uniformly at predetermined potential by the primary charging screen corotron 18 and an image corresponding to the predetermined color is exposed by the ROS 13 on the surface of the photographic drum 17 to form the electrostatic latent image. The electrostatic latent image formed corresponding to each color on the surface of the photographic drum 17 is developed by the corresponding color developer 19Y, 19M, 19C or 19BK. Then, a toner image T of the predetermined color is formed on the surface of the photographic drum 17.

For instance, when the electrostatic latent image formed on the photographic drum 17 is one which corresponds to yellow, this electrostatic latent image is developed by the yellow developer 19Y and a yellow toner image T is formed on the photographic drum 17. A toner image T of corresponding color is formed on the photographic drum 17 one after another by the same process for magenta, cyan and black.

The toner image T of each color formed one after another on the photographic drum 17 is transferred from the photographic drum 17 to the surface of the intermediate transfer belt 21 at the primary transfer position where the photographic drum 17 contacts with the intermediate transfer belt 21. A semi-conductive bias roller 22 for primary transfer is disposed at the back of the intermediate transfer belt 21 at the primary transfer position so that the intermediate transfer belt 21 contacts with the surface of the photographic drum 17 by the bias roller 22. Voltage of reverse polarity from the toner charge polarity is applied to the bias roller 22 so that the toner image T formed on the photographic drum 17 is transferred to the intermediate transfer belt 21 by the press-contact force and electrostatic force.

Although the toner image T of a predetermined color primarily transferred to the intermediate transfer belt 21 is transferred secondarily to the copy sheet 26 immediately in forming a black-and-white image, the processes for forming the toner image T of a predetermined color on the photographic drum 17 and for primarily transferring the toner image T to the intermediate transfer belt 21 are repeated by the number of predetermined colors in forming a color image in which plural colors of toner images T are superimposed.

For instance, when a full color image in which toner images T of four colors of yellow (Y), magenta (M), cyan (C) and black (BK) are superimposed is to be formed, the toner image T of each color of yellow (Y), magenta (M), cyan (C) and black (BK) is formed on the photographic drum 17 one after another per turn thereof and the four color toner images are transferred to the intermediate transfer belt 21 primarily while being superimposed one after another.

At this time, the intermediate transfer belt 21 turns at cycle synchronized with the photographic drum 17 while holding the non-fixed toner image T of yellow primarily transferred at first. Then, the non-fixed toner images T of magenta, cyan and black are transferred to the intermediate transfer belt 21 at predetermined position decided by a position detecting sensor 45 while superimposing on the yellow non-fixed toner image T one after another per turn thereof.

The non-fixed toner image T primarily transferred to the intermediate transfer belt 21 is conveyed to a secondary transfer position facing to the conveying route of the copy sheet 26 as the intermediate transfer belt 21 rotates.

The copy sheet 26 is fed from the predetermined sheet feed cassette 28, 29, 30 or 31 by the feed roller 28*a*, 29*a*, 30*a* or 31*a* as described above. It is then conveyed to the resist roller 33 by the conveyor roller 32 and is fed to the nip between the secondary transfer roller 27 and the intermediate transfer belt 21 by the resist roller 33 at predetermined timing.

The backup roller 25 which is an opposed electrode of the secondary transfer roller 27 is disposed on the back of the intermediate transfer belt 21 at the secondary transfer position. The non-fixed toner image T transferred to the intermediate transfer belt 21 is transferred secondarily to the copy sheet 26 electrostatically at the secondary transfer position by press-contacting the semiconductive secondary transfer roller 27 with the intermediate transfer belt 21 at predetermined timing at the secondary transfer position and by applying voltage whose polarity is inverse from the toner charge polarity to the backup roller 25.

According to this present embodiment, the voltage of the same polarity with the toner charging polarity is not applied directly to the secondary transfer roller 27 as shown in FIG. 3. The voltage of the same polarity with the toner charging polarity is applied to the backup roller 25 which press-contacts with the secondary transfer roller 27 via the intermediate transfer belt 21 from a transfer biasing high-voltage source 47 as a transfer bias voltage applying section by a bias roller 46. However, it is of course possible to apply the voltage of the same polarity with the toner charging polarity directly to the secondary transfer roller 27.

Then, the copy sheet 26 on which the non-fixed toner image has been transferred is peeled off from the intermediate transfer belt 21 and is fed to the fixing unit 35 by an electrode member 48, a guide plate 49 and a conveyor belt 34 disposed at the downstream of the secondary transfer section to fix the non-fixed toner image T.

Meanwhile, an intermediate transfer belt cleaner 43 removes the residual toner on the intermediate transfer belt 21 from which the non-fixed toner image T has been transferred secondarily.

Synthetic resin such as polyimide, polycarbonate, polyether, polypropylene or the like or various rubber containing an appropriate amount of charge preventing agent such as carbon black is used as the intermediate transfer belt 21 so that its volume resistivity becomes $10^6$ to $10^{14}$ ohm·cm. The thickness of the intermediate transfer belt 21 is set at 0.1 mm for example. It is noted that the peripheral length of the intermediate transfer belt 21 is set at integer times, e.g., three times, of the peripheral length of the photographic drum 17.

The secondary transfer roller 27 and the intermediate transfer belt cleaner 43 are disposed so that it can contact/separate to/from the intermediate transfer belt 21. At least, the intermediate transfer belt cleaner 43 is separated from the intermediate transfer belt 21 until the final color non-fixed toner image T is transferred primarily to the intermediate transfer belt 21 in forming a color image.

The secondary transfer roller 27 is composed of a surface layer made of urethane rubber tube in which carbon is dispersed and an internal layer made of foaming urethane rubber in which carbon is dispersed. Fluorine coating is implemented on the surface of the secondary transfer roller 27. The volume resistivity of the secondary transfer roller 27 is set at $10^3$ to $10^{10}$ ohm/□, the roll diameter thereof is set at ϕ28 mm and the hardness thereof is set at 30° (asca C) for example.

Meanwhile, the backup roller 25 is composed of a surface layer made of a tube of EPDM and NBR blend rubber in which carbon is dispersed and an internal layer made of EPDM rubber. The volume resistivity thereof is set at $10^7$ to $10^{10}$ ohm/□, the roll diameter thereof is set at ϕ28 mm and the hardness thereof is set at 70° (asca C) for example.

The electrode member 48 disposed at the downstream of the nip at the secondary transfer position is preferably a plate as a conductive plate member. In the present embodiment, a stainless steel plate of 0.5 mm thick which is needle like on the side of the copy sheet 26 is used. Further, the edge of the electrode member 48 on the secondary transfer area side is disposed so that it is shifted to the secondary transfer roller 27 side from a line of the nip between the backup roller 25 and the secondary transfer roller 27 by 1 mm and is separated from the output port of the nip by 7 mm.

By the way, the fixing unit of the first embodiment includes a fixing roller having a heating source therein, a pressurizing member for press-contacting with the fixing roller and an external heating member for heating the surface of the fixing roller from the outside.

Figure 4:
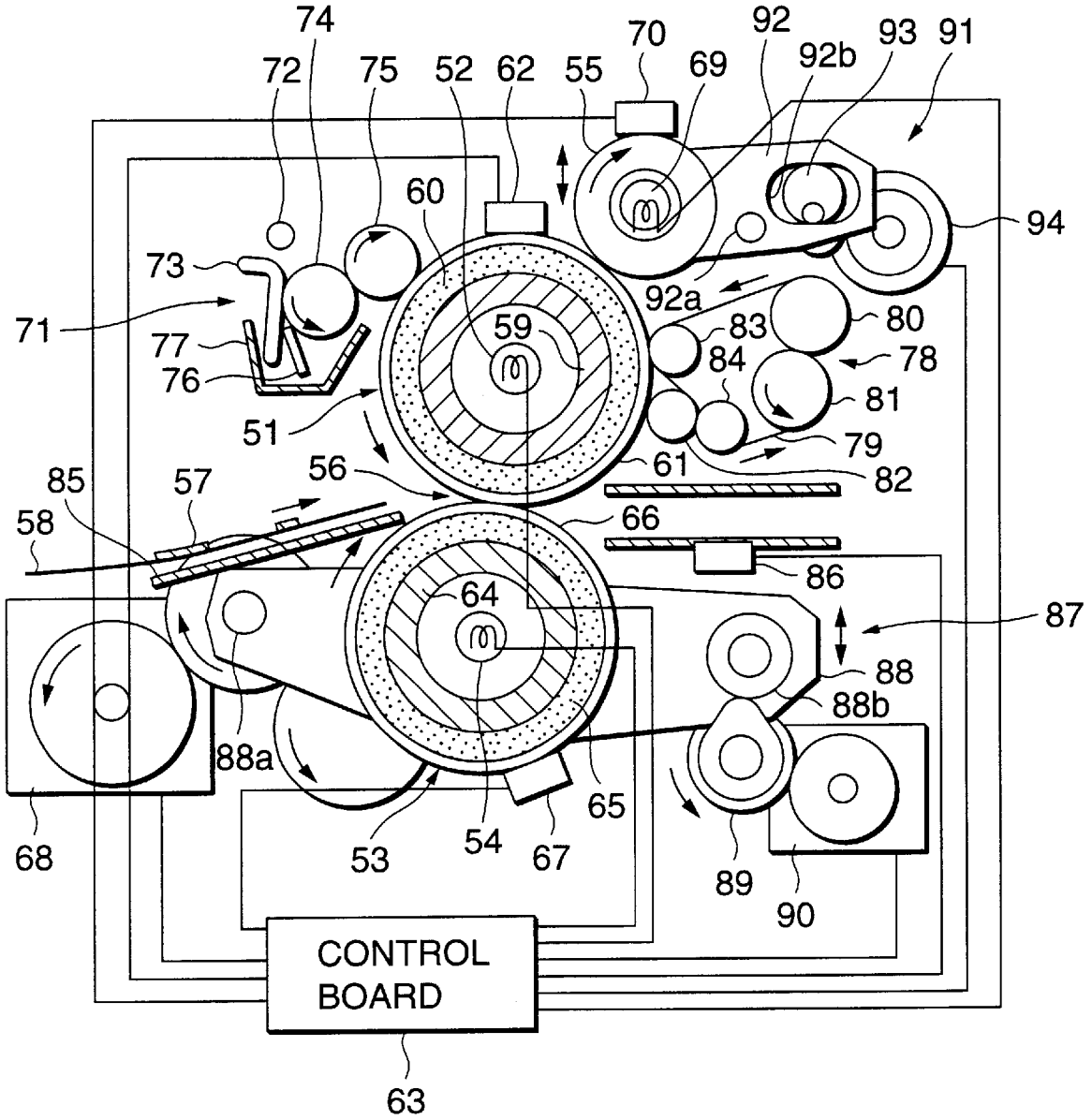
FIG. 4 is a diagram showing the structure of the fixing unit of the first embodiment of the invention.

FIG. 4 is a diagram showing the structure of the fixing unit of the first embodiment of the invention.

As shown in FIG. 4, the main part of the fixing unit 35 is composed of the fixing roller 51 which has the heating source 52 therein and turns in the direction of an arrow, a pressure roller 53 which is disposed so as to press-contact with the fixing roller 51, has a heating source 54 therein and turns in the direction of an arrow and the external heating roller 55 which abuts to/separates from the surface of the fixing roller 51 at predetermined timing. The non-fixed toner image 57 is fixed on the copy sheet 26 by heat and pressure by passing the copy sheet 26 as a transfer medium on which the non-fixed toner image 57 has been transferred through the nip part 56 formed between the fixing roller 51 and the pressure roller 53.

The fixing roller 51 includes a halogen lamp 52 of 350 W as the heating source therein and is composed of a metal hollow core 59 made of iron, stainless steel or aluminum whose thermal conductivity is high, a heat resistant elastic layer 60 made of silicon rubber or the like whose thickness is 3 mm and a top coat layer 61 made of very thin fluorine rubber or the like. The fixing roller 51 is heated from the inside by the halogen lamp 52 so that its surface temperature rises to predetermined temperature. A temperature sensor 62 as a first temperature detecting section which contacts to the surface of the fixing roller 51 detects the surface temperature of the fixing roller 51 and a control board 63 as a control section controls the surface temperature of the fixing roller 51 so that it rises to the predetermined temperature, e.g., 160° C.

Meanwhile, the pressure roller 53 includes a halogen lamp 54 of 350 W as the auxiliary heating source therein and is composed of a metal hollow core 64 made of iron, stainless steel or aluminum whose thermal conductivity is high, a heat resistant elastic layer 65 made of silicon rubber or the like whose thickness is 1 mm and a top coat layer 66 made of very thin fluorine rubber or the like. The pressure roller 53 is heated from the inside by the halogen lamp 54 so that its surface temperature rises to predetermined temperature.

A temperature sensor 67 as a second temperature detecting section which contacts to the surface of the pressure roller 53 detects the surface temperature of the pressure roller 53 and the control board 63 controls the surface temperature of the pressure roller 53 so that it rises to the predetermined temperature, e.g., 130° C.

The pressure roller 53 is driven and turned at predetermined speed along the direction of an arrow via plural gears by a driving motor 68. Meanwhile, the fixing roller 51 is arranged so as to be driven and turn while pressure-contacting to the pressure roller 53.

Further, the external heating roller 55 includes a halogen lamp 69 of 300 W as a heating source therein and is composed of a metal hollow core itself made of iron, stainless steel or aluminum whose thermal conductivity is high. The external heating roller 55 is heated from the inside by the halogen lamp 69 so that its surface temperature rises to predetermined temperature. A temperature sensor 70 as a third temperature detecting section which contacts to the surface of the external heating roller 55 detects the surface temperature of the external heating roller 55 and the control board 63 controls the surface temperature of the external heating roller 55 so that it rises to predetermined temperature, e.g., 180° C.

The fixing roller 51 and the pressure roller 53 press-contact each other at predetermined load at least during the fixing process and are driven and turned at predetermined processing speed (fixing speed) corresponding to a type of the copy sheet 26 and to an image forming mode. In case of a plain paper for example, the fixing roller 51 and the pressure roller 53 are turned at speed of 220 mm/sec. at this time. In case of fixing a thick paper 1 (basis weight: 105 to 162 gsm), the fixing roller 51 and the pressure roller 53 are turned at slower speed of 130 mm/sec. for example. In case of fixing a transparent film such as an OHP sheet and a thick paper 2 (basis weight: 163 gsm or more), the fixing roller 51 and the pressure roller 53 are turned at considerably slow speed of 60 mm/sec. for example.

Then, the non-fixed toner image 57 is fixed on the copy sheet 26 by heat and pressure by passing the copy sheet 26 on which the non-fixed toner image 57 has been transferred through the nip part 56 formed between the fixing roller 51 and the pressure roller 53.

The fixing unit 35 is also provided with parting agent supplying unit 71 for applying oil as parting agent for preventing offset on the surface of the fixing roller 51 as shown in FIG. 4.

The parting agent supplying unit 71 is arranged such that silicon oil as the parting agent is dropped to a wick 73 made of unwoven cloth or the like from an oil supplying pipe 72 to which the oil is supplied to apply the oil on the surface of an oil pickup roller 74 via the wick 73. The oil adhering on the surface of the oil pickup roller 74 is applied to the surface of the fixing roller 51 via an oil donor roller 75. An amount of oil applied to the surface of the fixing roller 51 is controlled by an oil metering blade 76 which contacts with the surface of the oil pickup roller 74 and the oil is applied uniformly along the axial direction of the oil pickup roller 74. It is noted that an extra oil wiped by the oil metering blade 76 is recovered to an oil catch pan 77 to supply again to the oil supply pipe 72.

According to the first embodiment, a cleaning unit 78 for cleaning the surface of the fixing roller 51 is also disposed. The cleaning unit 78 removes toner, paper dust or the like adhering on the surface of the fixing roller 51 by supplying a cleaning web 79 which can be freely wound up from a web supply roll 80, by pressing a cleaning roll 82 made of a metallic roller to the surface of the fixing roller 51 while winding the cleaning web 79 by a web recovering roller 81 and by pressing the cleaning web 79 to the surface of the fixing roller 51 by a web pressing roller 83 made of sponge or the like. The toner or the like removed by the cleaning roll 82 is removed by the cleaning web 79 which is pressed to the surface of the cleaning roll 82 by an auxiliary roller 84.

It is noted that, in FIG. 4, the reference numeral (85) denotes an inlet shoot for guiding the copy sheet 58 to the nip part 56 between the fixing roller 51 and the pressure roller 53 and (86) a paper detecting sensor provided at the outlet side of the nip part 56, respectively.

The fixing unit of the first embodiment also includes an abutting/separating unit for abutting/separating the external heating member to/from the surface of the fixing roller and a control unit for controlling timing for abutting the external heating member to the surface of the fixing roller in correspondence to at least either one of the surface temperature of the external heating member and/or fixing roller, the type of the transfer medium which undergoes the fixing process and an image forming mode with respect to the transfer medium.

Figure 5:
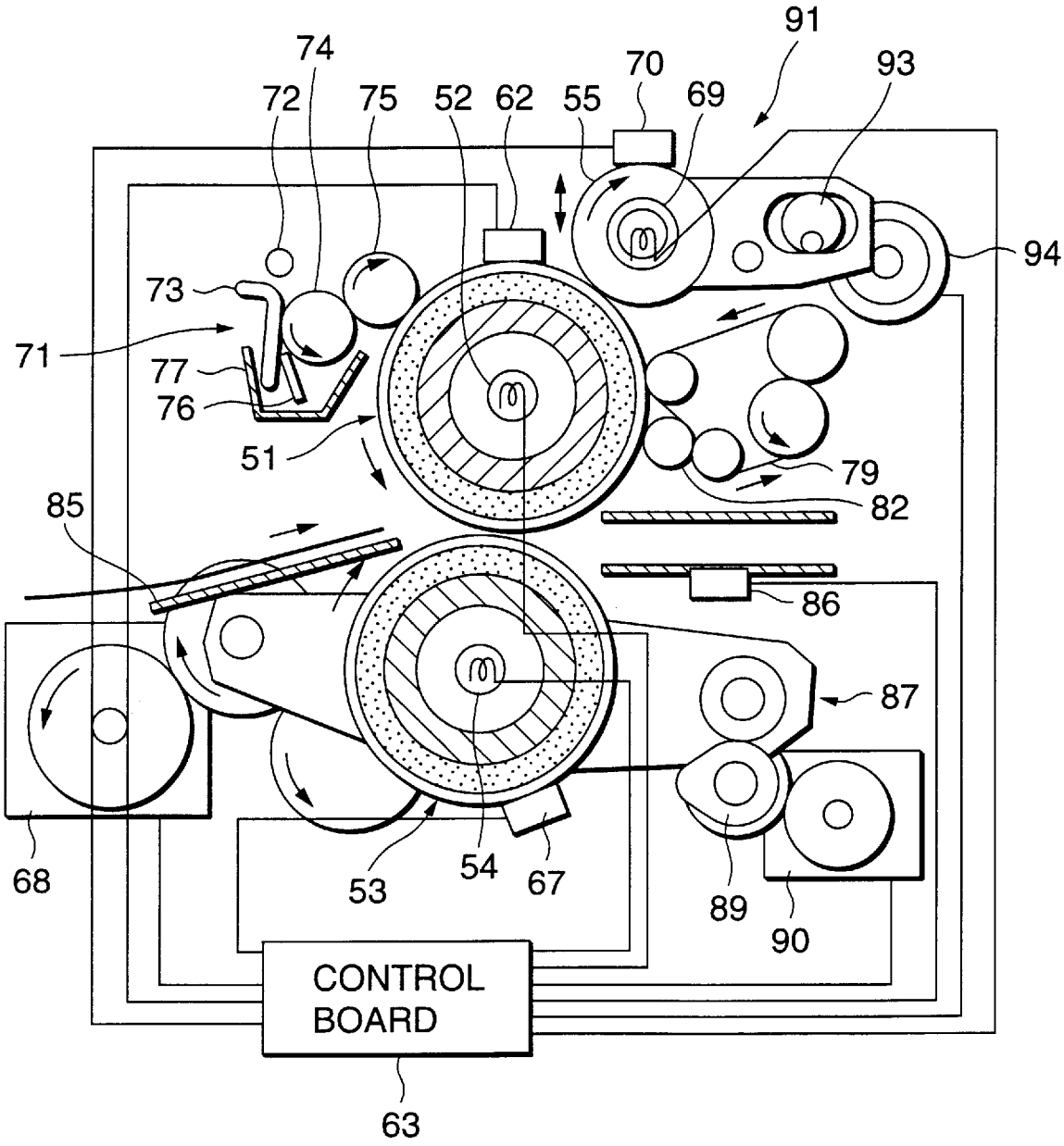
FIG. 5 is a diagram showing the structure of the fixing unit of the first embodiment of the invention.

That is, the fixing unit 35 is arranged such that the pressure roller 53 may be abutted/separated to/from the fixing roller 51 by a first abutting/separating device 87 so that the pressure roller 53 press-contacts with the surface of the fixing roller 51 at predetermined timing as shown in FIG. 4. The pressure roller 53 is turned by the driving motor 68 while being turnably attached to a first support arm 88. The support arm 88 freely oscillates along the direction of an arrow centering on a fulcrum 88*a*. The support arm 88 press-contacts the pressure roller 53 with the fixing roller 51 or separates the pressure roller 53 from the fixing roller 51 by about 2 mm for example by turning an eccentric cam 89 which abuts to a roller 88*b* provided at the edge of the arm 88 by a cam driving motor 90 as shown in FIG. 5.

Figure 6:
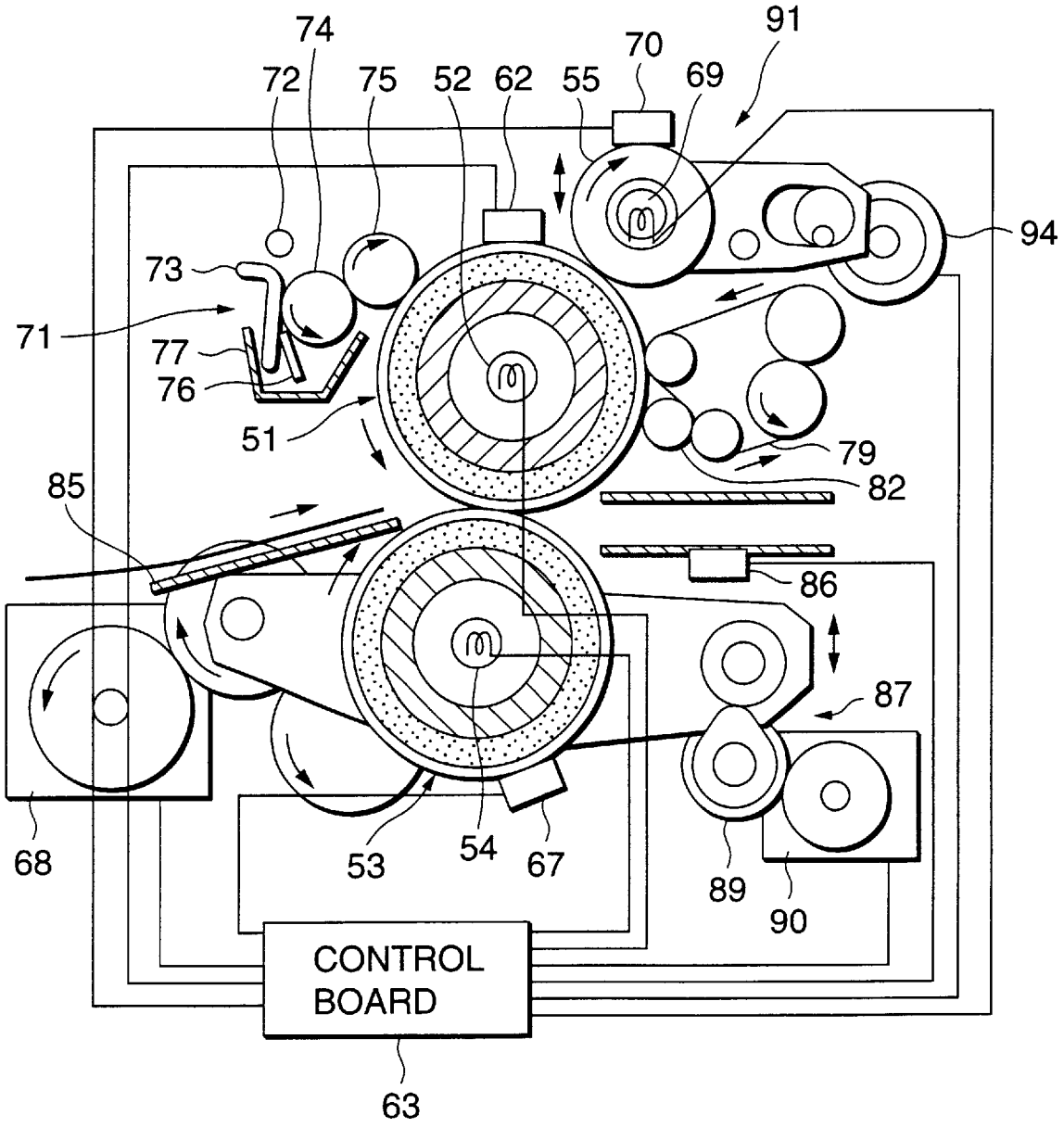
FIG. 6 is a diagram showing the structure of the fixing unit of the first embodiment of the invention.

Further, according to the first embodiment, the external heating roller 55 is arranged so that it is capable of abutting/separating to/from the surface of the fixing roller 51 at predetermined timing by a second abutting/separating device 91 as shown in FIG. 4. The external heating roller 55 is turnably attached to a second support arm 92. The second support arm 92 oscillates freely along the direction of an arrow centering on a fulcrum 92*a*. The support arm 92 abuts the external heating roller 55 to the fixing roller 51 or separates the external heating roller 55 from the fixing roller 51 by about 1 mm for example as shown in FIG. 6 by turning an eccentric cam 93 fitted to a concave groove cam follower 92*b* provided at one end of the arm by a cam driving motor 94.

Figure 7:
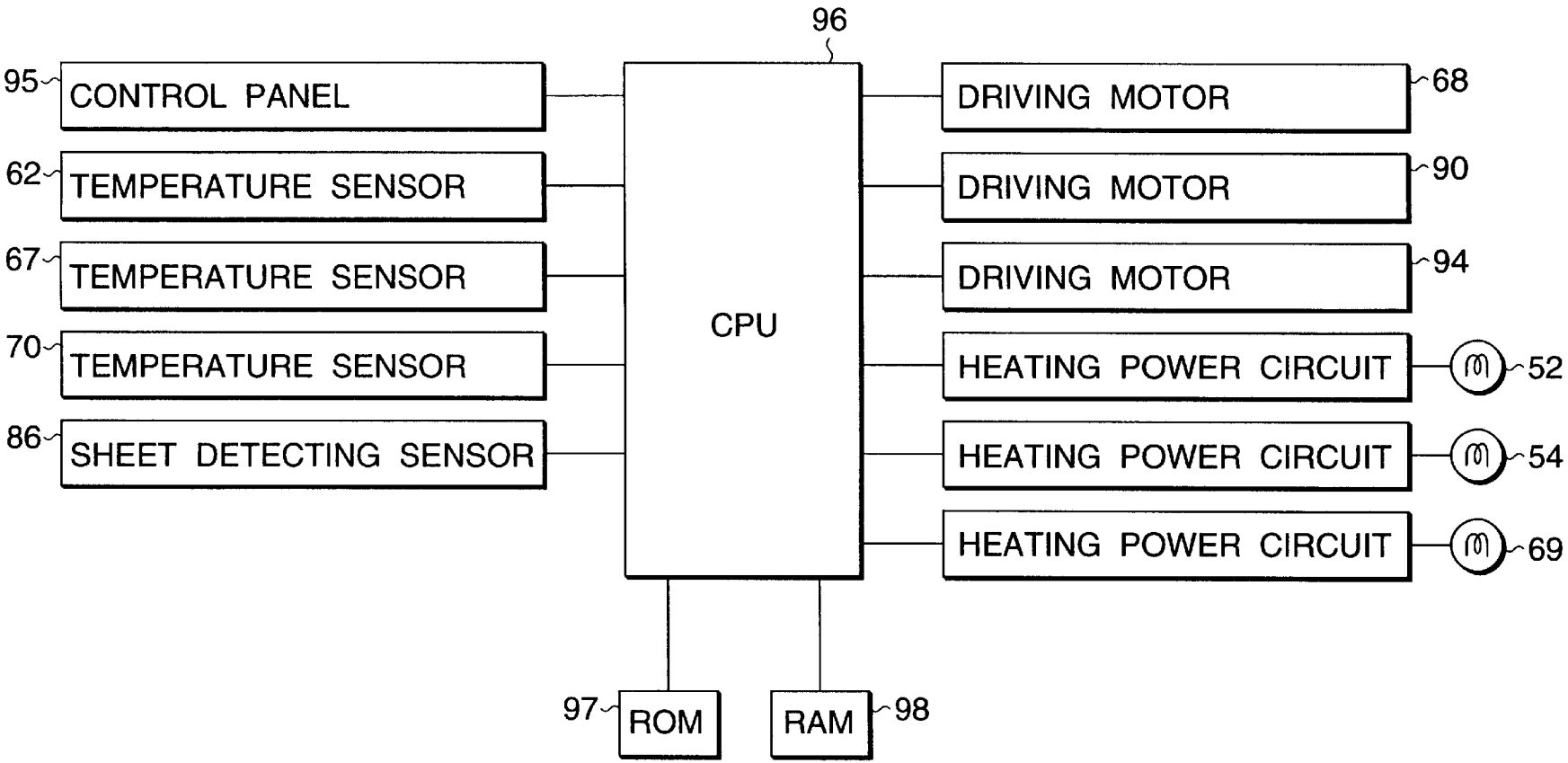
FIG. 7 is a block diagram showing the structure of a control board of the fixing unit of the first embodiment of the invention.

FIG. 7 is a diagram showing the structure of the control board of the fixing unit of the first embodiment.

In FIG. 7, the reference numeral (95) denotes a control panel of the color electrophotographic copying machine to which the fixing unit 35 of the first embodiment is applied. An operator specifies a number of sheets to be copied, the copy sheet 26 whether it is a plain paper or a thick paper or an OHP transparent film, or the image forming mode is a black-and-white mode or a color mode through the control panel 95.

A CPU 96 for controlling operations of the whole copying machine including the fixing unit 35 controls the timing for abutting the fixing roller 51 with the external heating roller 55 as described later corresponding to the type of the copy sheet 26 and the image forming mode specified through the control panel 95.

The reference numeral (97) denotes an ROM storing programs and tables of control operations executed by the CPU 96 and (98) an RAM storing parameters required for the control operations executed by the CPU 96.

By constructing as described above, it becomes possible to prevent the surface temperature of the fixing roller from becoming too high or too low and to obtain always good fixing performance even when the fixing unit of the first embodiment is arranged so as to abut the external heating roller to the surface of the fixing roller to heat the surface of the fixing roller by the external heating roller.

Figure 10:
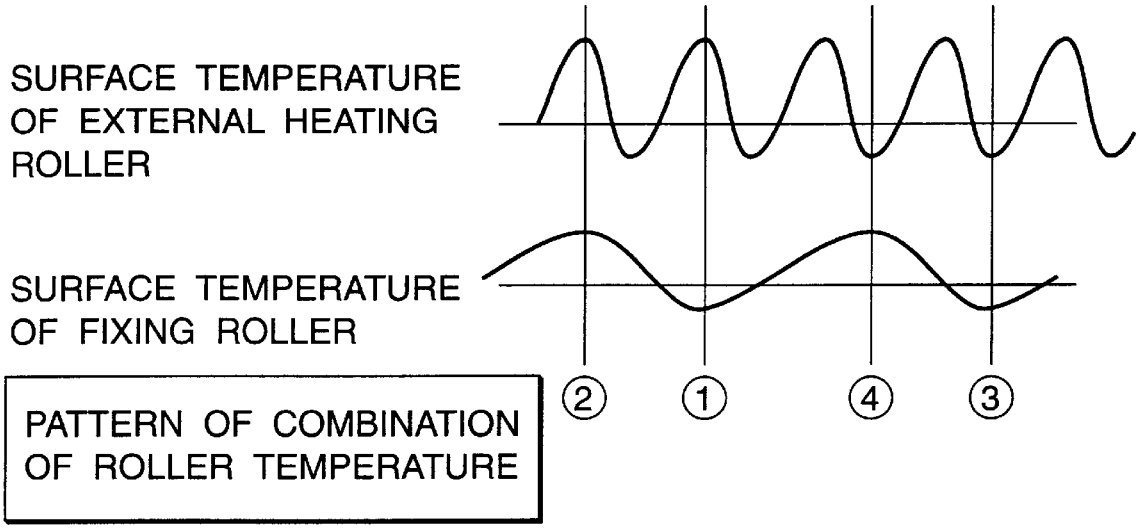
FIG. 10 is a graph showing changes of surface temperature of an external heating roller and a fixing roller.

That is, in the fixing unit 35, when a printing operation is started as shown in FIG. 8, the CPU 96 executes an operation for taking in the roller temperature at the point of time when a start key is pressed for example and takes in the surface temperature $T_{EXT}$ of the external heating roller 55 and the surface temperature $T_H$ of the fixing roller 51 by temperature sensors 62 and 70 (Step 101). It is noted that although the surface temperature of the external heating roller 55 and the fixing roller 51 is controlled so that it becomes equal to predetermined set temperature by the control board 63, it repeats periodic fluctuation as shown in FIG. 10 as power fed to the halogen lamps 52 and 69, i.e., the heating sources, is turned on and off. At this time, the following four cases are possible as patterns of combination of the surface temperatures of the external heating roller 55 and the fixing roller 51:

(1) the surface temperature $T_{EXT}$ of the external heating roller 55 is high and the surface temperature $T_H$ of the fixing roller 51 is low;

(2) the surface temperature $T_{EXT}$ of the external heating roller 55 as well as the surface temperature $T_H$ of the fixing roller 51 is high;

(3) the surface temperature $T_{EXT}$ of the external heating roller 55 as well as the surface temperature $T_H$ of the fixing roller 51 is low; and (4) the surface temperature $T_{EXT}$ of the external heating roller 55 is low and the surface temperature $T_H$ of the fixing roller 51 is high.

Next, the CPU 96 calculates the difference $\Delta T_{EXT-H}=T_{EXT}-T_H$ of the surface temperatures of the external heating roller 55 and the fixing roller 51 (Step 102) and takes in information on the color mode (image forming mode) and on the paper type of the copy sheet 26 (Step 103) as shown in FIG. 8. Here, it discriminates whether the mode (image forming mode) is the color mode or the black-and-white mode and whether the paper type of the copy sheet 58 is a plain paper (basis weight is less than 105 gsm), a thick paper 1 (basis weight is 105 gsm or more and less than 162 gsm), a thick paper 2 (basis weight is 163 gsm or more) or an OHP sheet.

After that, the CPU 96 decides abutment patterns A through E which determine the timing for abutting the external heating roller 55 to the surface of the fixing roller 51 corresponding to the surface temperature $T_{EXT}$ of the external heating roller 55 and the difference $\Delta T_{EXT-H}$ of the surface temperatures of the external heating roller 55 and the fixing roller 51, the image forming mode and the type of the copy sheet by making reference to a table set in advance as shown in FIG. 8 (Step 104).

Figure 9:
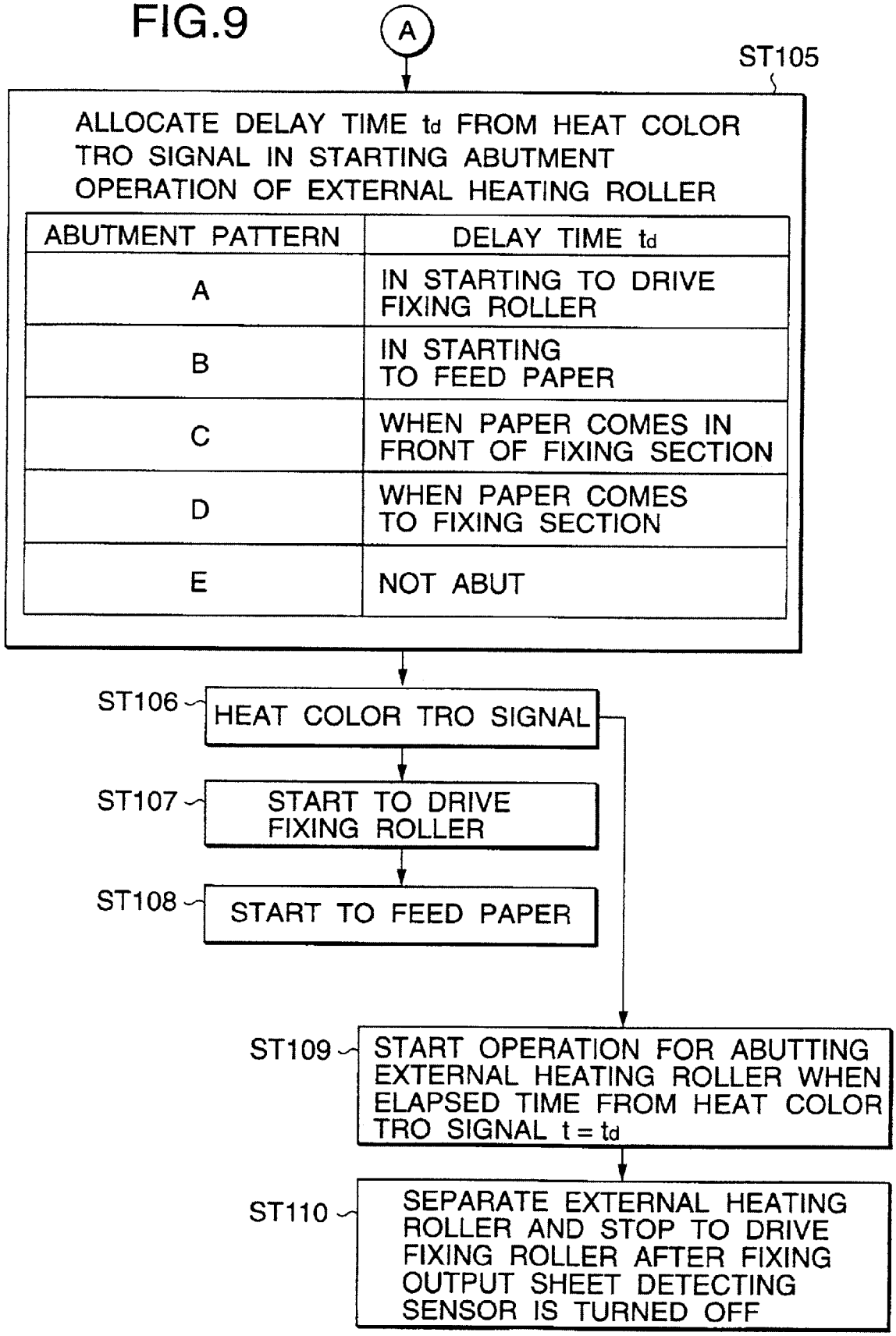
FIG. 9 is a flowchart showing the fixing operation of the fixing unit of the first embodiment of the invention.

Then, the CPU 96 allocates a delay time $t_d$ from a head color TRO signal for starting the operation for abutting the external heating roller 55 as shown in FIG. 9 (Step 105). Here, the head color TRO signal means an image writing start signal in writing a first color image on the photographic drum 17 by the ROS 14 in case of the color mode and means an image writing start signal in writing a black-and-white image on the photographic drum 17 by the ROS 14 in case of the black-and-white mode.

Abutment pattern A is what abuts the external heating roller 55 to the surface of the fixing roller 51 in starting to drive the fixing roller 51 in Step 105 in FIG. 9. The fixing roller 51 is turned together with the pressure roller 53 in the same time when the start key is pressed for example. It is noted that the fixing roller 51 is press-contacted with the pressure roller 53 at this time. Abutment pattern B is what abuts the external heating roller 55 to the surface of the fixing roller 51 when the copy sheet 26 is started to be fed from either one of the sheet feeder cassettes 28 through 31 as shown in FIG. 2. Abutment pattern C is what abuts the external heating roller 55 to the surface of the fixing roller 51 when the copy sheet 26 fed from either one of the sheet feeder cassettes 28 through 31 comes in front of the fixing unit 35, i.e., when it comes to the secondary transfer position of the intermediate transfer belt 21, as shown in FIG. 2. Abutment pattern D is what abuts the external heating roller 55 to the surface of the fixing roller 51 when the copy sheet 26 fed from either one of the sheet feeder cassettes 28 through 31 arrives at the fixing part of the fixing unit 35 as shown in FIG. 2 and Abutment pattern E is what does not abut the external heating roller 55 to the surface of the fixing roller 51.

Figure 11:
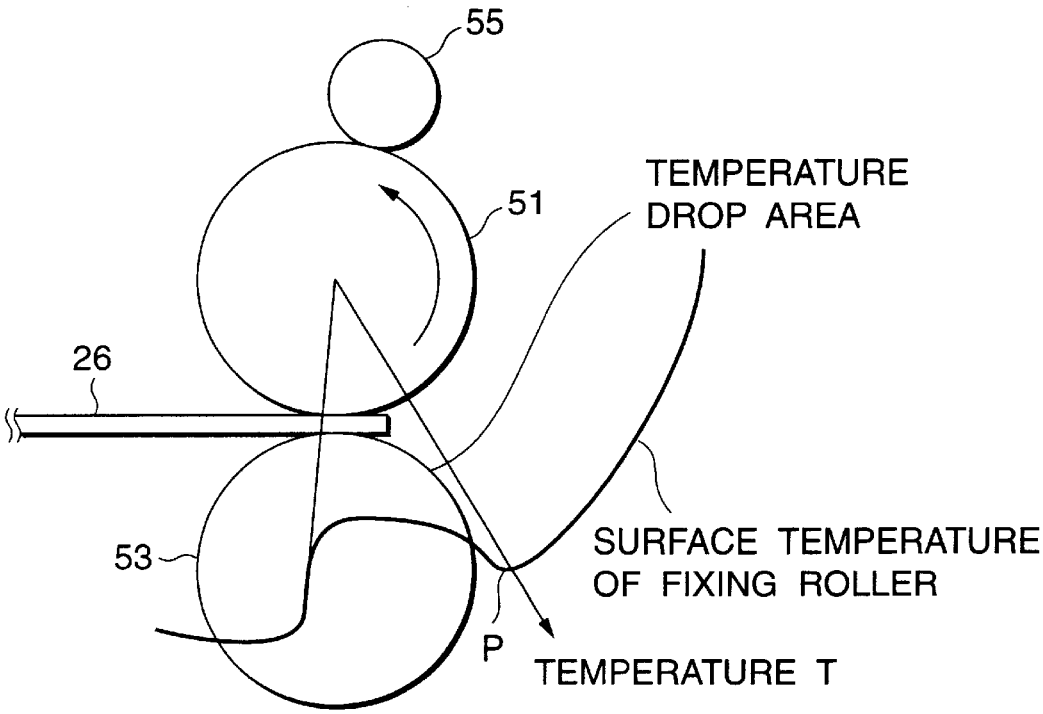
FIG. 11 is a diagram for explaining the changes of surface temperature of the fixing roller.

Here, the time when the copy sheet 26 arrives at the fixing part of the fixing unit 35 is set when the copy sheet 26 enters the nip part 56 of the fixing unit 35, heat of the fixing roller 51 is taken away by the copy sheet 26 and the edge P of an area where the surface temperature of the fixing roller 51 has dropped reaches to the position of the external heating roller 55 as shown in FIG. 11. Thereby, the external heating roller 55 whose temperature is relatively high abuts to the surface of the fixing roller 51 before the area from which the heat of the fixing roller 51 is taken away by the copy sheet 26 reaches to the external heating roller 55 and it becomes possible to prevent the surface of the fixing roller 51 from being heated excessively by the external heating roller 55 when the copy sheet 26 enters the nip part 56 of the fixing unit 35.

Next, when the heat color TRO signal is outputted (Step 106), the CPU 96 starts to drive the fixing roller 51 (Step 107) and starts to feed the papers (Step 108).

Further, the CPU 96 counts an elapsed time from the head color TRO signal in the same time when the head color TRO signal is outputted (Step 106) and drives the cam driving motor 94 of the second abutting/separating device 92 at the point of time when the elapsed time t from the heat TRO signal becomes equal to the delay time $t_d$ set in Step 105 to abut the external heating roller 55 to the surface of the fixing roller 51 (Step 109).

Then, the CPU 96 separates the external heating roller 55 and stops to drive the fixing roller 51 after when the predetermined fixing operation ends and the fixing output sheet detecting sensor 86 is turned off (Step 110).

Thus, the fixing unit 35 of the first embodiment is constructed so as to differentiate the timing for abutting the external heating roller 55 to the surface of the fixing roller 51 corresponding to the surface temperature $T_{EXT}$ of the external heating roller 55, the difference $\Delta T_{EXT-H}$ of the surface temperatures of the external heating roller 55 and the fixing roller 51, the image forming mode and the type of the copy sheet 26 as shown in FIGS. 8 and 9.

When the surface temperature $T_{EXT}$ of the external heating roller 55 is higher than predetermined temperature T1, e.g., 180° C., and the difference $\Delta T_{EXT-H}$ of the surface temperatures of the external heating roller 55 and the fixing roller 51 is higher than predetermined temperature T2, e.g., 20° C., the timing for abutting the external heating roller 55 to the surface of the fixing roller 51 is determined to be the abutment pattern C regardless whether the mode is the color mode or the black-and-white mode or regardless of the type of the copy sheet 26 as shown in Step 104 in FIG. 8. That is, the timing for abutting the external heating roller 55 to the surface of the fixing roller 51 is set when the copy sheet 26 comes in front of the fixing part.

In this case, the surface temperature $T_{EXT}$ of the external heating roller 55 is sufficiently higher than the predetermined temperature T1, e.g., 180° C., as indicated by (1) in FIG. 10 and the difference $\Delta T_{EXT-H}$ of the surface temperatures of the external heating roller 55 and the fixing roller 51 is also higher than the predetermined temperature T2, e.g., 20° C. Therefore, there is a possibility that the surface temperature of the fixing roller 51 is relatively low by that and the surface temperature of the fixing roller 51 is lower than the predetermined set temperature, e.g., 160° C. Accordingly, the fixing process may be performed favorably even in the color mode in which a toner amount is relatively large or in the black-and-white mode or regardless of the type of the copy sheet 26 by abutting the external heating roller 55 to the surface of the fixing roller 51 at the point of time when the copy sheet 26 comes in front of the fixing part and by performing the fixing process in the state when the surface of the fixing roller 51 has been heated in advance by the external heating roller 55 whose temperature is fully high. It is noted that the abutment pattern is not different even in case of the thick paper, the OHP sheet and the plain paper because the fixing process may be performed favorably because the fixing speed is set slow in case of the thick paper and the OHP sheet.

Next, when the surface temperature $T_{EXT}$ of the external heating roller 55 is higher than the predetermined temperature T1, e.g., 180° C., and the difference $\Delta T_{EXT-H}$ of the surface temperatures of the external heating roller 55 and the fixing roller 51 is lower than the predetermined temperature T2, e.g., 20° C., the abutment pattern D is set in cases other than the OHP sheet and the abutment pattern E is set in case of the OHP sheet in the color mode as shown in Step 104 in FIG. 8. That is, the timing for abutting the external heating roller 55 to the surface of the fixing roller 51 is set when the copy sheet 26 comes to the fixing part in cases other than the OHP sheet and the external heating roller 55 is not abutted to the surface of the fixing roller 51 in case of the OHP sheet.

In this case, although the surface temperature $T_{EXT}$ of the external heating roller 55 is fully higher than the predetermined temperature T1, e.g., 180° C., as indicated by (2) in FIG. 10, the difference $\Delta T_{EXT-H}$ of the surface temperatures of the external heating roller 55 and the fixing roller 51 is lower than the predetermined temperature T2, e.g., 20° C. Therefore, the surface temperature of the fixing roller 51 exceeds the predetermined set temperature, e.g., 160° C. Accordingly, it is fully possible to prevent the surface temperature of the fixing roller 51 from dropping and to perform the fixing process favorably even in the color mode when the copy sheet 26 is not the OHP sheet by giving heat which has been taken away in fixing the copy sheet 26 to the fixing roller 51 by the external heating roller 55 by abutting the external heating roller 55 to the surface of the fixing roller 51 at the point of time when the copy sheet 26 comes to the fixing part.

Figure 12:
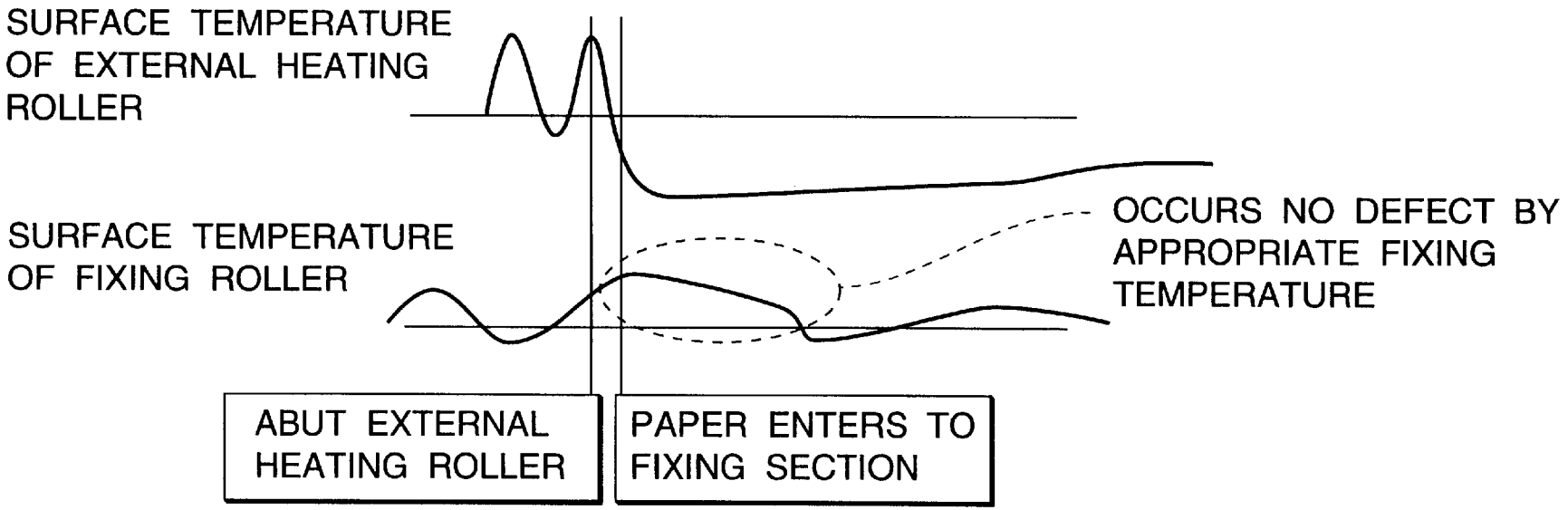
FIG. 12 is a graph showing changes of surface temperature of the external heating roller and the fixing roller.

Thus, when the surface temperature $T_{EXT}$ of the external heating roller 55 is higher than the predetermined temperature T1, e.g., 180° C., and the difference $\Delta T_{EXT-H}$ of the surface temperatures of the external heating roller 55 and the fixing roller 51 is lower than the predetermined temperature T2, e.g., 20° C., it becomes possible to prevent the surface temperature of the fixing roller 51 from rising considerably by giving only the heat taken away in fixing the copy sheet 26 to the fixing roller 51 by the external heating roller 55 by abutting the external heating roller 55 to the surface of the fixing roller 51 at the point of time when the copy sheet 26 comes to the fixing part as shown in FIG. 12. Therefore, it is possible to prevent the surface temperature of the fixing roller 51 from rising considerably, the non-fixed toner image 57 to be fixed on the copy sheet 26 from melting excessively, the gross from deteriorating, an amount of toner transferring to the surface of the fixing roller 51 from increasing as called as hot offset or the deterioration of the elastic layer 53 and the top coat layer 54 of the fixing roller 51 from being quickened. Further, because the surface temperature of the fixing roller 51 will not become so high as compared the predetermined temperature, it is possible to steadily prevent the synthetic resin films such as the OHP sheet and the tack film from being softened and from being wrapped around the surface of the fixing roller 51, thus making the fixing process impossible, even when the copy sheet 26 made of the synthetic resin film called as the OHP sheet and the tack film is used.

It is noted that because the processing speed is set slow in case of the OHP sheet, the heat taken away by fixing the OHP sheet may be recovered only by the heating source 52 of the fixing roller 51. Then, the fixing process may be performed favorably even in the color mode without abutting the external heating roller 55 to the fixing roller 51.

Meanwhile, in case of the black-and-white mode, the abutment pattern C is set when the copy sheet 26 is the plain paper and the OHP sheet and the abutment pattern D is set when the copy sheet 26 is the thick paper 1 and the thick paper 2 as shown in Step 104 in FIG. 8. That is, the timing for abutting the external heating roller 55 to the surface of the fixing roller 51 is set when the copy sheet 26 comes in front of the fixing part in case of the plain paper and the OHP sheet and is set when the copy sheet 26 comes to the fixing part in case of the thick paper 1 and the thick paper 2.

In this case, the surface temperature $T_{EXT}$ of the external heating roller 55 is fully high temperature because it is higher than the predetermined temperature T1, e.g., 180° C., and the difference $\Delta T_{EXT-H}$ of the surface temperatures of the external heating roller 55 and the fixing roller 51 is lower than the predetermined temperature T2, e.g., 20° C., so that the surface temperature of the fixing roller 51 also exceeds the predetermined set temperature, e.g., 160° C. as indicated by (3) in FIG. 10. At this time, the fixing speed is set at the same fast speed when the copy sheet 26 is the plain paper and OHP sheet and the surface of the fixing roller 51 is heated more or less by the external heating roller 55 by abutting the external heating roller 55 to the surface of the fixing roller 51 at the point of time when the copy sheet 26 comes in front of the fixing part. Thereby, the fixing process may be performed favorably even in the black-and-white mode when the copy sheet 26 is the plain paper and the OHP sheet.

It is noted that the fixing speed of the plain paper and the OBH sheet is set at the same fast speed in case of the black-and-white mode because it is not necessary to consider coloring and translucency so much like the case of the full-color toner image in fixing the black-and-white toner image on the OHP sheet and the fixing speed may be increased because the black-and-white toner image is only required to be reliably fixed on the OHP sheet.

The abutment pattern is set to be relatively slow in the color mode as compared to the black-and-white mode under the condition indicated by (2) in FIG. 10 because the latitude of the surface temperature of the fixing roller 51 is wide and the fixing process may be performed favorably even if the surface temperature of the fixing roller 51 is high more or less in case of the black-and-white mode as compared to the color mode in which the latitude of the surface temperature of the fixing roller 51 is narrow because an amount of toner which offset on the surface of the fixing roller 51 increases when the surface temperature of the fixing roller 51 is too high.

Meanwhile, the fixing process may be performed favorably even in the black-and-white mode by setting the abutment pattern D by compensating the heat taken away by fixing on the thick paper by the external heating roller 55 because the processing speed (fixing speed) is set slow in case of the thick paper 1 and the thick paper 2.

Next, when the surface temperature $T_{EXT}$ of the external heating roller 55 is lower than the predetermined temperature T1, e.g., 180° C., and the difference $\Delta T_{EXT-H}$ of the surface temperatures of the external heating roller 55 and the fixing roller 51 is higher than the predetermined temperature T2, e.g., 20° C., the abutment pattern A is set as the timing for abutting the external heating roller 55 to the surface of the fixing roller 51 only when the type of the copy sheet 26 is the plain paper in the color mode as shown in Step 104 in FIG. 8. When the type of the copy sheet 26 is one other than the plain paper, the abutment pattern B is set as the timing for abutting the external heating roller 55 to the surface of the fixing roller 51.

Because the surface temperature $T_{EXT}$ of the external heating roller 55 is relatively low because it is lower than the predetermined temperature T1, e.g., 180° C., and the difference $\Delta T_{EXT-H}$ of the surface temperatures of the external heating roller 55 and the fixing roller 51 is higher than the predetermined temperature T2, e.g., 20° C., the surface temperature of the fixing roller 51 is relatively low by that and the surface temperature of the fixing roller 51 is lower than the predetermined set temperature, e.g., 160° C. as indicated by (3) in FIG. 10. Therefore, the fixing process may be performed favorably on the plain paper even in the color mode in which the toner amount is relatively large by abutting the external heating roller 55 to the surface of the fixing roller 51 at the point of time when the fixing roller 51 is started to be driven and by performing the fixing process in the state in which the surface temperature of the fixing roller 51 is increased for sufficient time by the external heating roller 55 because the processing speed (fixing speed) is faster in case when the type of the copy sheet 26 is the plain paper as compared to the other papers.

When the type of the copy sheet 26 is the thick paper 1, the thick paper 2 and the OHP sheet other than the plain paper, the processing speed (fixing speed) is slow as compared to the case of the plain paper. Then, the fixing process may be performed favorably on the thick paper 1, the thick paper 2 and the OHP sheet even in the color mode in which a toner amount is relatively large by abutting the external heating roller 55 to the surface of the fixing roller 51 at the point of time when the copy sheet 26 is started to be fed and by performing the fixing process in the state in which the surface temperature of the fixing roller 51 is increased for certain period of time by the external heating roller 55.

In case of the black-and-white mode, the abutment pattern A is set as the timing for abutting the external heating roller 55 to the surface of the fixing roller 51 only when the type of the copy sheet 26 is the plain paper and the OHP sheet. The abutment pattern B is set as the timing for abutting the external heating roller 55 to the surface of the fixing roller 51 when the type of the copy sheet 26 is the thick paper 1 or the thick paper 2.

In this case, because the surface temperature $T_{EXT}$ of the external heating roller 55 is relatively low because it is lower than the predetermined temperature T1, e.g., 180° C., as indicated by (3) in FIG. 10 and the difference $\Delta T_{EXT-H}$ of the surface temperatures of the external heating roller 55 and the fixing roller 51 is higher than the predetermined temperature T2, e.g., 20° C., the surface temperature of the fixing roller 51 is relatively low by that and the surface temperature of the fixing roller 51 is lower than the predetermined set temperature, e.g., 160° C. Therefore, the fixing process may be performed favorably to the plain paper even in the black-and-white mode by abutting the external heating roller 55 to the surface of the fixing roller 51 at the point of time when the fixing roller 51 is started to be driven and by performing the fixing process in the state in which the surface temperature of the fixing roller 51 is increased for sufficient time by the external heating roller 55 because the processing speed (fixing speed) is faster than the case of the other papers when the type of the copy sheet 26 is the plain paper. It is noted that the fixing process may be performed favorably on the OHP sheet even in the black-and-white mode by abutting the external heating roller 55 to the surface of the fixing roller 51 at the point of time when the fixing roller 51 is started to be driven and by performing the fixing process in the state in which the surface temperature of the fixing roller 51 is increased for sufficient time by the external heating roller 55 similarly to the plain paper because the processing speed (fixing speed) is fast similarly to the plain paper when the type of the copy sheet 26 is the OHP sheet.

When the type of the copy sheet 26 is the thick paper 1 and the thick paper 2, the fixing process may be performed favorably on the thick paper 1 and the thick paper 2 even in the black-and-white mode by abutting the external heating roller 55 on the surface of the fixing roller 51 at the point of time when the copy sheet 26 is started to be fed and by performing the fixing process in the state in which the surface temperature of the fixing roller 51 is increased for a certain period of time by the external heating roller 55 because the processing speed (fixing speed) is slow as compared to the plain paper.

Still more, when the surface temperature $T_{EXT}$ of the external heating roller 55 is lower than the predetermined temperature T1, e.g., 180° C., and the difference $\Delta T_{EXT-H}$ of the surface temperatures of the external heating roller 55 and the fixing roller 51 is also lower than the predetermined temperature T2, e.g., 20° C., the abutment pattern B is set in case of the plain paper, the abutment pattern C is set in case of the thick paper 1 and the thick paper 2 and the abutment pattern E is set in case of the OHP sheet, respectively, in the color mode as shown in Step 104 in FIG. 8. That is, the timing for abutting the external heating roller 55 to the surface of the fixing roller 51 is set when the paper is started to be fed in case where the copy sheet 26 is the plain paper and when the paper comes in front of the fixing part in case where the copy sheet 26 is the thick paper 1 and the thick paper 2. The external heating roller 55 is not abutted to the surface of the fixing roller 51 in case of the OHP sheet.

In this case, the surface temperature $T_{EXT}$ of the external heating roller 55 is relatively low because it is lower than the predetermined temperature T1, e.g., 180° C., and the surface temperature of the fixing roller 51 is higher than the predetermined set temperature, e.g., 160° C. because the difference $\Delta T_{EXT-H}$ of the surface temperatures of the external heating roller 55 and the fixing roller 51 is also lower than the predetermined temperature T2, e.g., 20° C. as indicated by (4) in FIG. 10. Therefore, the fixing process may be performed favorably on the plain paper even in the color mode by raising the surface temperature of the fixing roller 51 sufficiently by heating the surface of the fixing roller 51 with the external heating roller 55 for a certain time by abutting the external heating roller 55 to the surface of the fixing roller 51 at the point of time when the paper is started to be fed.

The fixing process may be performed favorably on the thick paper 1 and the thick paper 2 even in the color mode by raising the surface temperature of the fixing roller 51 sufficiently by heating the surface of the fixing roller 51 with the external heating roller 55 by abutting the external heating roller 55 to the surface of the fixing roller 51 at the point of time when the paper comes in front of the fixing part because the processing speed (fixing speed) is set slow in case of the thick paper 1 and the thick paper 2.

The fixing process may be performed favorably also in the color mode without abutting the external heating roller 55 to the fixing roller 51 because the processing speed is set slow in case of the OHP sheet and the heat taken away by fixing on the OHP sheet may be recovered only by the heating source 52 of the fixing roller 51.

Meanwhile, in case of the black-and-white mode, the abutment pattern A is set in case of the plain paper and the OHP sheet and the abutment pattern C is set in case of the thick paper 1 and the thick paper 2 as shown in Step 104 in FIG. 8. That is, the timing for abutting the external heating roller 55 to the surface of the fixing roller 51 is set at the point of time when the fixing roller 51 is started to be driven in case of the plain paper and the OHP sheet and is set at the point of time when the copy sheet 26 comes in front of the fixing part in case of the thick paper 1 and the thick paper 2.

In this case, although the surface temperature $T_{EXT}$ of the external heating roller 55 is relatively low because it is lower than the predetermined temperature T1, e.g., 180° C., the surface temperature of the fixing roller 51 is higher than the predetermined set temperature, e.g., 160° C., because the difference $\Delta T_{EXT-H}$ of the surface temperatures of the external heating roller 55 and the fixing roller 51 is lower than the predetermined temperature T2, e.g., 20° C. as indicated by (4) in FIG. 10. Therefore, the fixing process may be performed favorably on the plain paper and the OHP sheet even in the black-and-white mode in which the fixation is low more or less by raising the surface temperature of the fixing roller 51 sufficiently by heating the surface of the fixing roller 51 by the external heating roller 55 for a certain period of time by abutting the external heating roller 55 to the surface of the fixing roller 51 at the point of time when the fixing roller is started to be driven in case of the plain paper and the OHP sheet.

The fixing process may be performed favorably on the thick paper 1 and the thick paper 2 even in the black-and-white mode in which the fixation is low more or less by raising the surface temperature of the fixing roller 51 sufficiently by heating the surface of the fixing roller 51 slightly by the external heating roller 55 by abutting the external heating roller 55 to the surface of the fixing roller 51 at the point of time when the paper comes in front of the fixing part because the fixing speed is slow in case of the thick paper I and the thick paper 2.

Accordingly, the fixing unit of the first embodiment is capable of always attaining the good fixing performance by preventing the surface temperature of the fixing roller from becoming too high or too low even when it is constructed so as to abut the external heating roller to the surface of the fixing roller to heat the surface of the fixing roller by the external heating roller.

Second Embodiment

Figure 13:
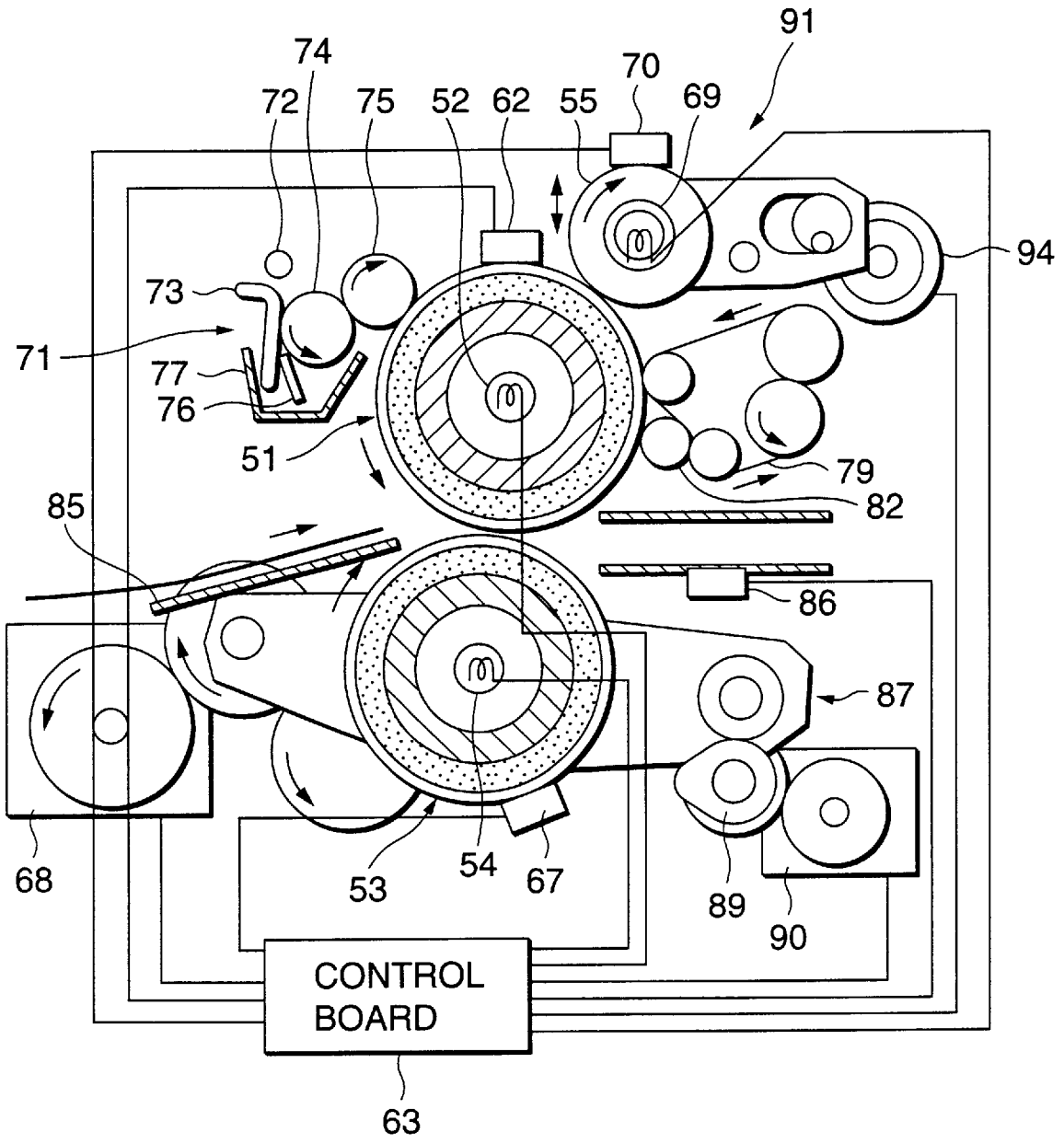
FIG. 13 is a diagram showing the structure of a fixing unit of a second embodiment of the invention.

FIG. 13 shows a fixing unit according to a second embodiment of the invention, wherein the same components with those in the first embodiment will be denoted by the same reference numerals. According to the second embodiment, the fixing unit includes a fixing roller having a heating source there in, a pressurizing member which has a heating source therein and press-contacts to the fixing roller, an external heating member which heats the surface of the fixing roller from the outside, a first abutting/separating device which press-contacts or separates the pressurizing member to/from the surface of the fixing roller, a second abutting/separating device which abuts/separates the external heating member to/from the surface of the fixing roller, and a control unit that controls so as to press-contact or abut at least two of the fixing roller, the pressurizing member and the external heating member when at least one of surface temperature of the fixing roller and the pressurizing member is lower than preset temperature at the point of time when the fixing process ends.

Figure 14:
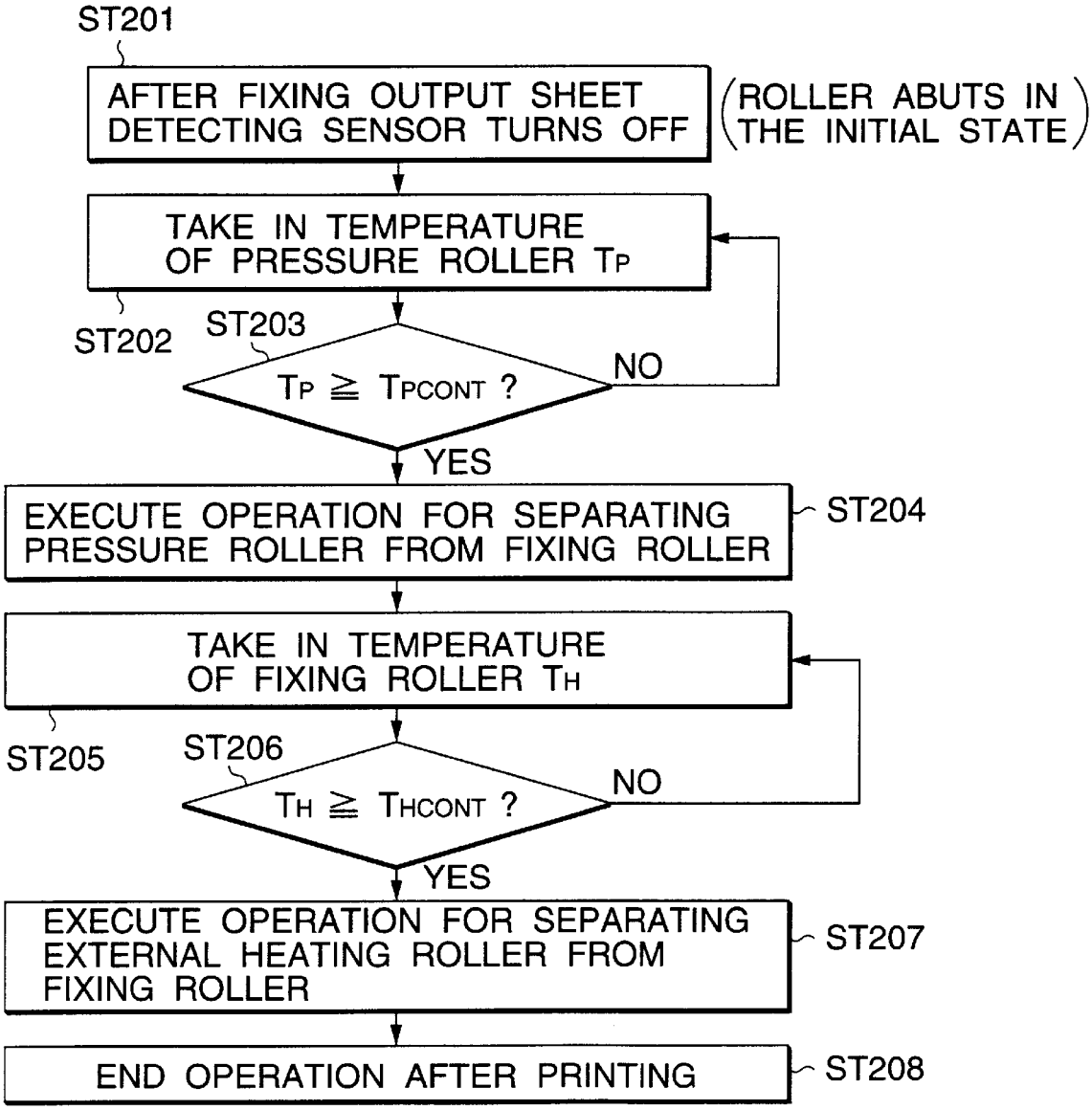
FIG. 14 is a flowchart showing a fixing operation of the fixing unit of the second embodiment of the invention.

That is, the fixing unit 35 of the second embodiment is arranged so as to detect the surface temperature of the fixing roller 51 and the pressure roller 53 by temperature sensors 62 and 67 after ending the fixing process and to control the timing for abutting/separating the fixing roller 51 and the pressure roller 53 or the timing for abutting/separating the fixing roller 51 and the external heating roller 55 corresponding to the surface temperature of the fixing roller 51 and the pressure roller 53 by the control board 63 as the control section as shown in FIG. 14.

By constructing as described above, the fixing unit of the second embodiment is capable of returning the surface temperature of the fixing roller to the preset temperature in a short time and of preventing overshoot and the like from occurring even when the fixing process is executed continuously as follows.

That is, after the fixing operation ends, the final copy sheet 26 passes through a fixing outlet sheet detecting sensor 86 and the sheet detecting sensor 86 is turned off (Step 201), the CPU 96 takes in the surface temperature $T_p$ of the pressure roller 53 in (Step 202) to discriminate whether or not the surface temperature $T_p$ of the pressure roller 53 exceeds predetermined temperature $T_{P\ cont}$, e.g., 130° C., (Step 203) in the fixing unit 35 of the second embodiment as shown in FIG. 14. Then, when the surface temperature $T_P$ of the pressure roller 53 is lower than the predetermined temperature $T_{P\ cont}$, the CPU 96 repeats the process for taking in the surface temperature of the pressure roller 53 (Step 202). Meanwhile, when the surface temperature $T_P$ of the pressure roller 53 exceeds the predetermined temperature $T_{P\ cont}$, the CPU 96 executes an operation for separating the pressure roller 53 from the fixing roller 51 (Step 204).

Next, the CPU 96 takes in the surface temperature $T_H$ of the fixing roller 51 (step 205) to discriminate whether or not the surface temperature $T_H$ of the fixing roller 51 exceeds the predetermined temperature $T_{H\ Cont}$, e.g., 160° C. (step 206). Then, when the surface temperature $T_H$ of the fixing roller 51 is lower than the predetermined temperature $T_{H\ cont}$, the CPU 96 repeats the process for taking in the surface temperature of the fixing roller 51 (Step 205). Meanwhile, when the surface temperature $T_H$ of the fixing roller 51 exceeds the predetermined temperature $T_{H\ cont}$, the CPU 96 executes an operation for separating the external heating roller 55 from the fixing roller 51 (Step 207) and ends the operation after printing (Step 208).

Thus, according to the second embodiment, the CPU 96 maintains the state in which the pressure roller 53 is abutted to the surface of the fixing roller 51 as shown in FIG. 15 when the surface temperature $T_P$ of the pressure roller 53 is lower than the predetermined temperature $T_{P\ cont}$ after the fixing operation ends, the final copy sheet 26 passes through a fixing outlet sheet detecting sensor 86 and the sheet detecting sensor 86 is turned off and maintains the state in which the external heating roller 55 is abutted to the surface of the fixing roller 51 when the surface temperature $T_H$ of the fixing roller 51 is lower than the predetermined temperature $T_{H\ cont}$. Thereby, the surface temperature of the fixing roller 51 rises gradually as it is heated by the external heating roller 55 and the surface temperature of the pressure roller 53 also rises gradually as it is heated by the fixing roller 51 as shown in FIG. 16.

Figure 16:
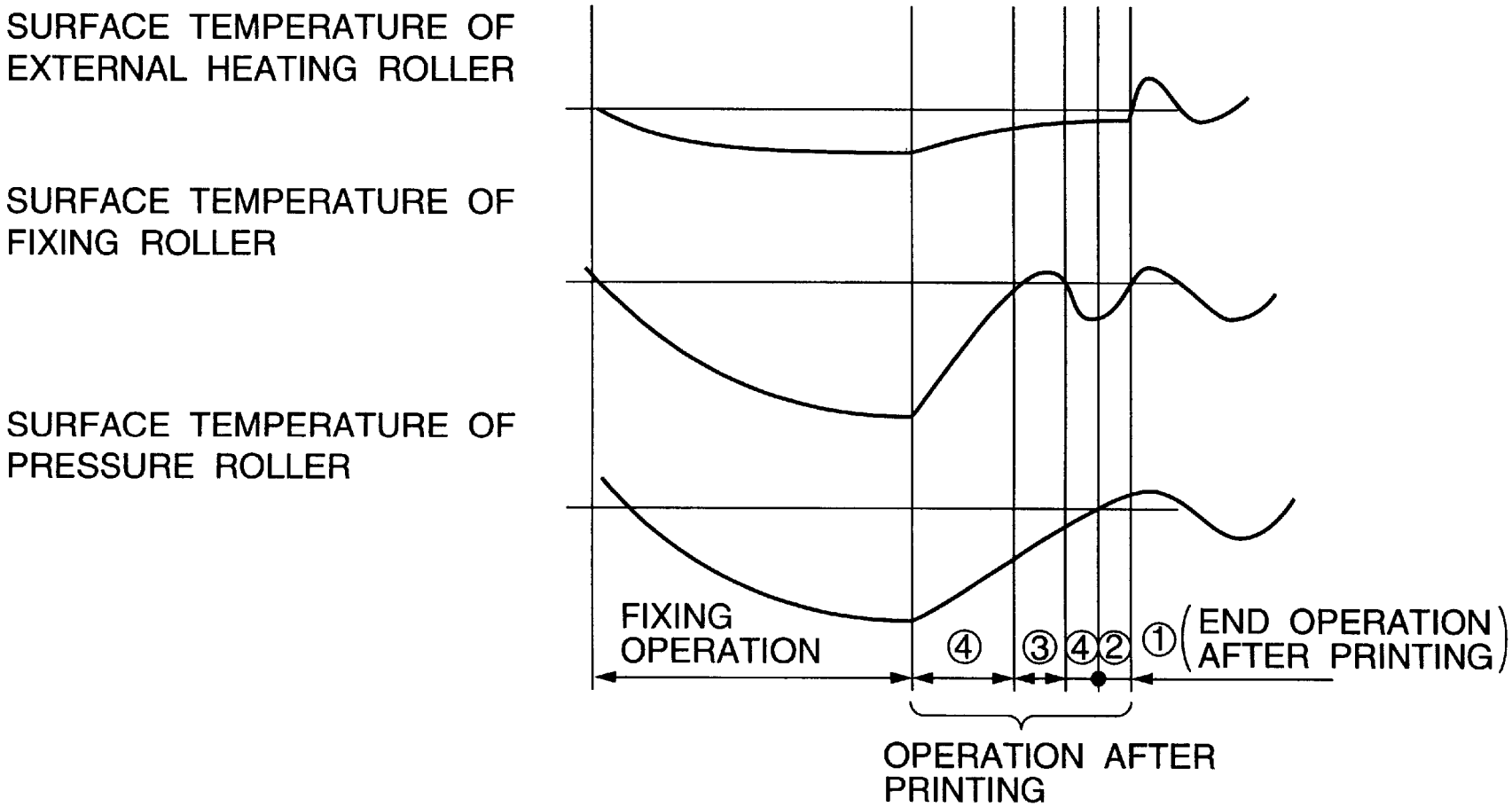
FIG. 16 is a graph showing changes of surface temperature of the external heating roller, the fixing roller and the pressure roller.
Figure 17:
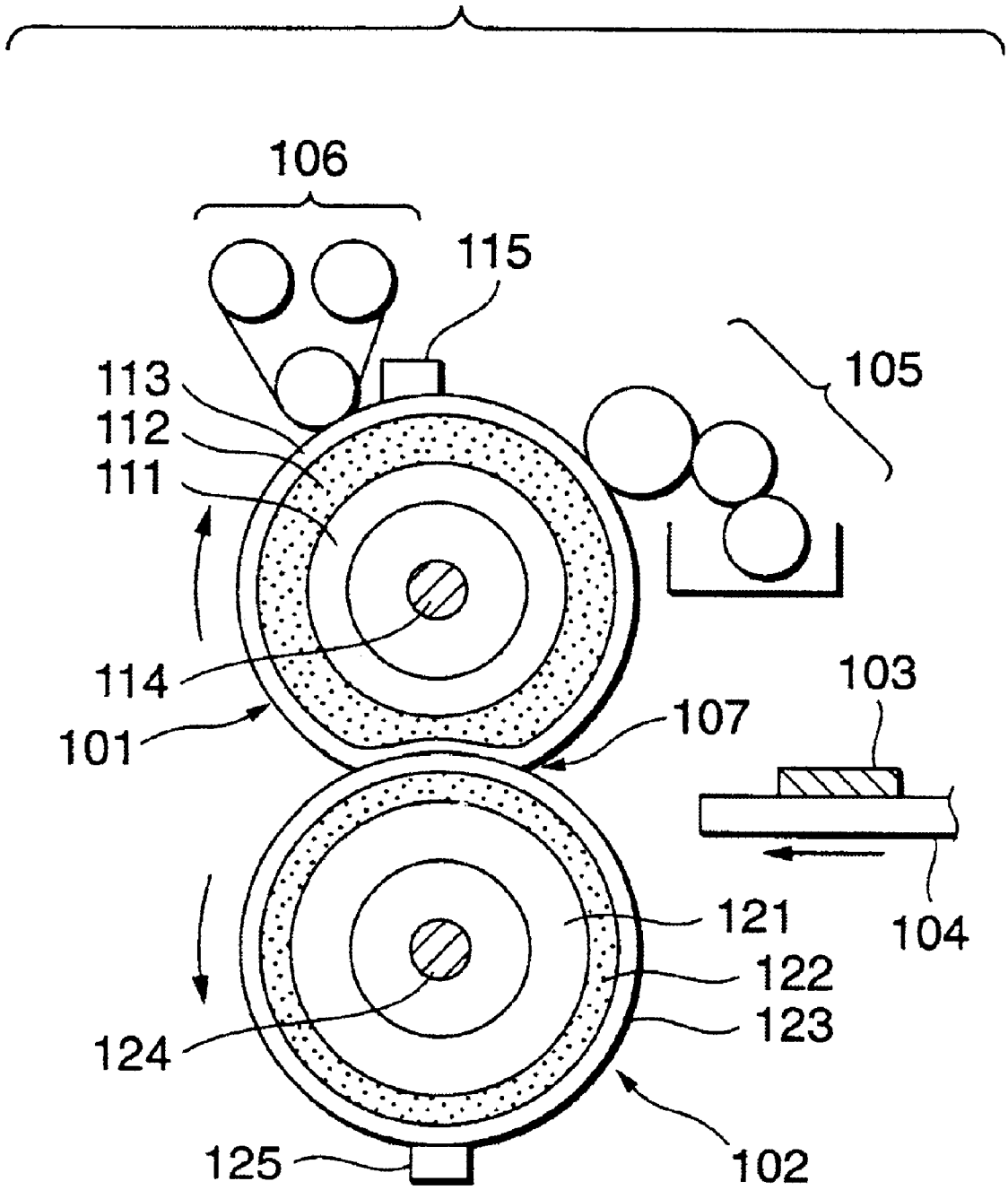
FIG.17 PRIOR ART
FIG. 17 is a diagram showing the structure of a prior art fixing unit.
Figure 18:
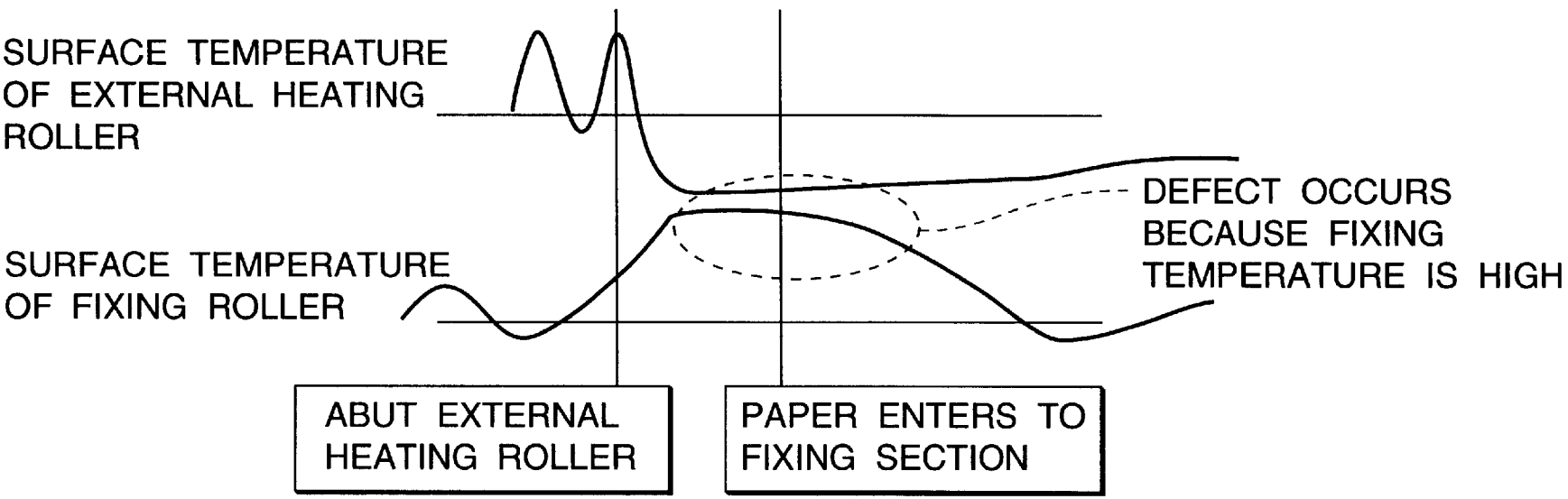
FIG. 18 is a graph showing changes of surface temperature of the external heating roller and the fixing roller.

The CPU 96 also maintains the state in which the pressure roller 53 is abutted to the surface of the fixing roller 51 and the state in which the external heating roller 55 is abutted to the surface of the fixing roller 51 as shown in FIG. 15 when the surface temperature $T_P$ of the pressure roller 53 is lower than the predetermined temperature $T_{P\ cont}$ even when the surface temperature of the fixing roller 51 rises and exceeds the predetermined temperature $T_{H\ cont}$ as shown in FIG. 16. Thereby, the operation for heating the pressure roller 53 by the external heating roller 55 via the fixing roller 51 may be continued. It is noted that the control board 63 turns off the power fed to the halogen lamp 52 and the surface temperature of the fixing roller 51 drops once when the surface temperature of the fixing roller 51 exceeds the predetermined temperature $T_{H\ cont}$.

After that, when the surface temperature of the pressure roller 53 rises and exceeds the predetermined temperature $T_{P\ cont}$ as shown in FIG. 16, the abutment of the pressure roller 53 and the fixing roller 51 is released and the state in which the external heating roller 55 is abutted to the surface of the fixing roller 51 is maintained as shown in FIG. 15. Thereby, the surface temperature of the pressure roller 53 exceeds the predetermined temperature $T_{P\ cont}$.

When the surface temperature of the fixing roller 51 rises further and exceeds the predetermined temperature $T_{H\ cont}$ as shown in FIG. 16, the abutment of the external heating roller 55 with the fixing roller 51 is released as shown in FIG. 15. Thereby, the surface temperature of the fixing roller 51 exceeds the predetermined temperature $T_{H\ cont}$.

Accordingly, it is possible to return the surface temperature of the fixing roller to the preset temperature in a short time and to prevent overshoot or the like from occurring even when the fixing process is executed continuously in case of the second embodiment.

The other construction and operations are the same with those in the first embodiment, so that its explanation will be omitted here.

As described above, according to a first aspect of the invention, it is possible to provide the fixing unit, and the image forming apparatus using the same, which is capable of preventing the surface temperature of the fixing roller from becoming too high or too low and of always attaining good fixing performance even when it is constructed so as to abut the external heating member to the surface of the fixing roller to heat the surface of the fixing roller by the external heating member.

Further, according to a second aspect of the invention, it is possible to provide the fixing unit, and the image forming apparatus using the same, which is capable of returning the surface temperature of the fixing roller to the preset temperature in a short time and of preventing overshoot or the like from occurring even when the fixing process is executed continuously.

The entire disclosure of Japanese patent application no. 11-338432 filed on Nov. 29, 1999 including specification, claims, drawings, summary and abstract is incorporated herein by reference in its entirety.

What is claimed is:

1. An image forming apparatus comprising:

a fixing unit that fixes on a transfer medium a black-and-white or color toner image which has been formed on the transfer medium by an image forming unit, the fixing unit comprising:

a fixing roller having a heating source therein;

a pressurizing member which press-contacts the fixing roller;

an external heating member which heats the surface of the fixing roller from the outside; and an abutting-separating device that makes the external heating member abut or separate from the surface of the fixing roller, and the image forming apparatus also comprising:

a control unit which controls timing for making the external heating member abut the surface of the fixing roller according to at least one of the surface temperature of the external heating member and/or fixing roller, the type of the transfer medium which undergoes the fixing process by the fixing unit and an image forming mode for the transfer medium.

2. The image forming apparatus according to claim 1, wherein the control unit controls the timing for making the external heating member abut the surface of the fixing roller according to the surface temperature of the external heating member and to the difference of the surface temperatures of the external heating member and the fixing roller.

3. An image forming apparatus comprising:

a fixing unit that fixes on a transfer medium a black-and-white or color toner image which has been formed on the transfer medium by an image forming unit, the fixing unit comprising:

a fixing roller having a heating source therein;

a pressurizing member which has a heating source therein and press-contacts the fixing roller;

an external heating member which heats the surface of the fixing roller from the outside;

a first abutting-separating device which makes the pressurizing member press-contact or separate from the surface of the fixing roller; and a second abutting-separating device which makes the external heating member abut or separate from the surface of the fixing roller, and the image forming apparatus also comprising:

a control unit that, if the surface temperature of at least one of the fixing roller and the pressurizing member is lower than a preset temperature at the point of time when the fixing process by the fixing unit ends, carries out at least one of control of continuous abutting of the external heating member on the fixing roller and control of continuous abutting of the pressurizing member on the fixing roller.

4. The image forming apparatus according to claim 3, wherein the control unit makes the external heating member abut the surface of the fixing roller if the surface temperature of the fixing roller is lower than the preset temperature at the point of time when the fixing process by the fixing unit ends.

5. The image forming apparatus according to claim 3, wherein the control unit maintains the state in which the pressurizing member is press-contacted to the fixing roller and makes the external heating member abut the surface of the fixing roller if the surface temperature of the pressurizing member is lower than the preset temperature at the point of time when the fixing process by the fixing unit ends.

6. The image forming apparatus according to claim 3, wherein the control unit maintains the state in which the pressurizing member is press-contacted to the fixing roller and makes the external heating member abut the surface of the fixing roller when the surface temperatures of the fixing roller and the pressurizing member are lower than the preset temperature at the point of time when the fixing process by the fixing unit ends.

7. An external heating method for heating the surface of a fixing roller having a heating source therein by making an external heating member abut the surface of the fixing roller, the external heating member being provided with an abutting-separating device for making the external heating member abut or separate from the surface of the fixing roller, the method comprising the steps of:

measuring the surface temperature of the fixing roller; and finding the difference between the surface temperature of the fixing roller measured in the previous step and predetermined temperature and deciding timing for making the external heating member abut the fixing roller by the abutting-separating device according to an image forming mode to make the external heating member abut the fixing roller by the abutting-separating device.

8. The external heating method according to claim 7, wherein the temperature measuring step is a step for measuring the surface temperature of the fixing roller as well as the surface temperature of the external heating member and the predetermined temperature is the surface temperature of the external heating member.

9. The external heating method according to claim 7, wherein the finding difference and deciding timing step is a step of finding the difference between the surface temperature of the fixing roller and the predetermined temperature to decide the timing for making the external heating member abut the fixing roller by the abutting-separating device according to the type of a transfer medium.

10. The external heating method according to claim 9, wherein the temperature measuring step is a step of measuring the surface temperature of the fixing roller as well as the surface temperature of the external heating member and the predetermined temperature is the surface temperature of the external heating member.

11. The external heating method according to claim 7, wherein the finding difference and deciding timing step is a step of finding the difference between the surface temperature of the fixing roller and the predetermined temperature to decide the timing for making the external heating member abut the fixing roller by the abutting-separating device according to the image forming mode and the type of a transfer medium.

12. The external heating method according to claim 11, wherein the temperature measuring step is a step of measuring the surface temperature of the fixing roller as well as the surface temperature of the external heating member and the predetermined temperature is the surface temperature of the external heating member.

13. An external heating method using the image forming apparatus of claim 3, the method comprising the steps of:

measuring and inputting the surface temperatures of the fixing roller and the pressurizing member at the point of time when the fixing process by the fixing unit ends; and providing a control for making at least one of the external heating member and the pressurizing member abut or press-contact the fixing roller if at least one of surface temperatures of the fixing roller and the pressurizing member is lower than a preset temperature.

14. The external heating method according to claim 13, wherein the surface temperature of the fixing roller is measured and input at the point of time when the fixing process by the fixing unit ends and a control is provided for making the external heating member abut the surface of the fixing roller if the surface temperature of the fixing roller is lower than the preset temperature.

15. The external heating method according to claim 13, wherein the surface temperature of the pressurizing member is measured and input at the point of time when the fixing process by the fixing unit ends and a control is provided for maintaining the state in which the pressurizing member is press-contacted to the fixing roller and making the external heating member abut the surface of the fixing roller if the surface temperature of the pressurizing member is lower than the preset temperature.

16. The external heating method according to claim 13, wherein the surface temperatures of the fixing roller and the pressurizing member are measured and input at the point of time when the fixing process by the fixing unit ends and a control is provided for maintaining the state in which the pressurizing member is press-contacted to the fixing roller and making the external heating member abut the surface of the fixing roller if the surface temperatures of the fixing roller and the pressurizing member are lower than the preset temperature.

* * * * *